US005819666A

United States Patent [19]

Ishikawa et al.

[11] Patent Number: 5,819,666

[45] Date of Patent: Oct. 13, 1998

[54] MAILING SYSTEM CONTROLLED BY THE COMPUTER SOFTWARE

[75] Inventors: Yuji Ishikawa; Heinz Schmitz, both of New Providence, Bahamas

[73] Assignee: Prinserter Corporation, New Providence, Bahamas

[21] Appl. No.: 913,419

[22] PCT Filed: Nov. 21, 1996

[86] PCT No.: PCT/JP96/03422

§ 371 Date: Sep. 15, 1997

§ 102(e) Date: Sep. 15, 1997

[87] PCT Pub. No.: WO97/28972

PCT Pub. Date: Aug. 14, 1997

[30] Foreign Application Priority Data

Feb. 8, 1996 [JP] Japan ..... 8-59955

[51] Int. Cl.[6] ..... B41C 00/00

[52] U.S. Cl. ..... 101/483; 53/411; 53/416; 270/1.03; 270/39.01; 270/39.07; 270/58.06; 364/478.08; 364/478.09; 364/478.1; 364/478.16

[58] Field of Search ..... 101/483, 267; 270/1.03, 39.01, 39.07, 58.06; 53/411, 416, 55, 440, 460, 117; 364/478.08, 478.09, 478.1, 478.16

[56] References Cited

U.S. PATENT DOCUMENTS

| | | | |
|---|---|---|---|
| 4,033,807 | 7/1977 | Neill | 101/267 |
| 4,942,535 | 7/1990 | Francisco | 53/540 |
| 4,972,655 | 11/1990 | Ogawa | 53/154 |
| 5,067,305 | 11/1991 | Baker et al. | 53/411 |
| 5,107,656 | 4/1992 | Katz et al. | 53/540 |
| 5,297,376 | 3/1994 | Taguuchi et al. | 53/55 |
| 5,339,603 | 8/1994 | Gombaurt et al. | 53/117 |
| 5,444,961 | 8/1995 | Doanne et al. | 53/117 |
| 5,538,232 | 7/1996 | Long | 270/103 |
| 5,612,888 | 3/1997 | Chane | 364/478.09 |
| 5,640,835 | 6/1997 | Muscoslat | 53/117 |
| 5,659,481 | 8/1997 | Qutab et al. | 364/478.08 |
| 5,706,627 | 1/1998 | Kirka et al. | 53/55 |

*Primary Examiner*—Eugene H. Eickholt
*Attorney, Agent, or Firm*—Young & Thompson

[57] ABSTRACT

The printing and post-processing system according to the invention provides as a compact integration unit a computer unit (10) for commanding with programs each component of the system for selective and controllable operation, a printer unit (12) selectively operable with program to print the sheet to be mailed, a folding unit (16) for folding the sheet with different folding modes including wrap and Z form foldings, a conveyor unit (18) for conveying the folded sheet with a selectively added enclosure to the enveloping or storing position, an envelope tray unit (20) for stacking a plurality of envelopes and discharging the same by piece, an insertion unit (22) for meeting the envelope with the folded sheet for subsequent insertion thereinto, a sealing unit (24) for sealing a flap of the envelope, a receiver unit (26) for receiving and storing the sealed envelopes therein, an enclosure supplying unit (28) for selectively supplying an enclosure to the conveyor unit.

31 Claims, 19 Drawing Sheets

FIG. 5B
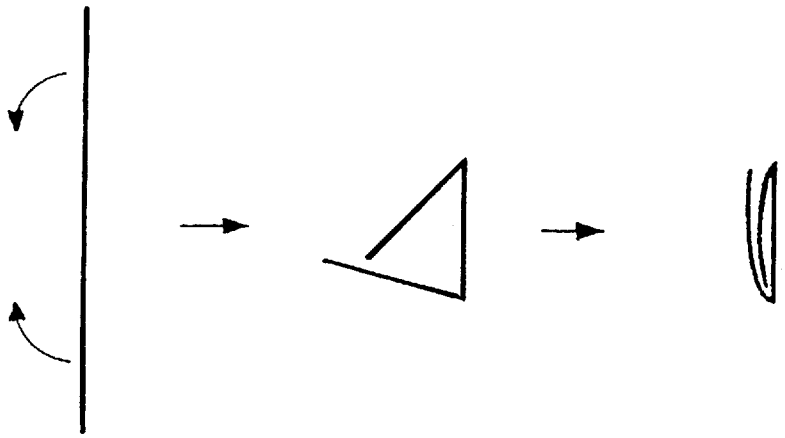
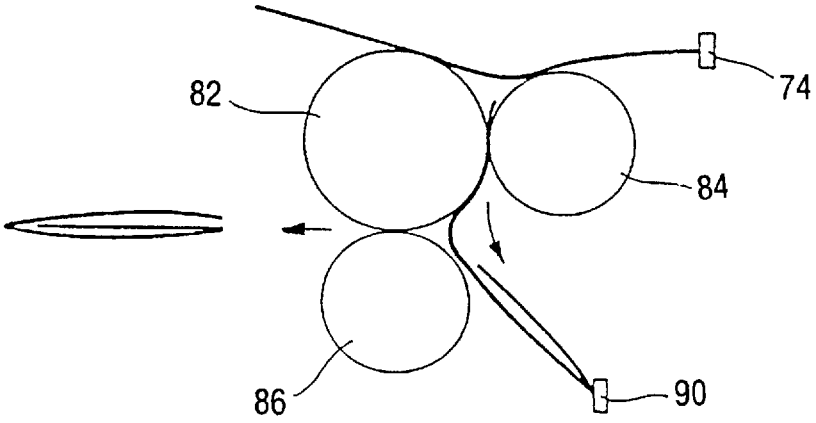
FIG. 5A

FIG. 6B
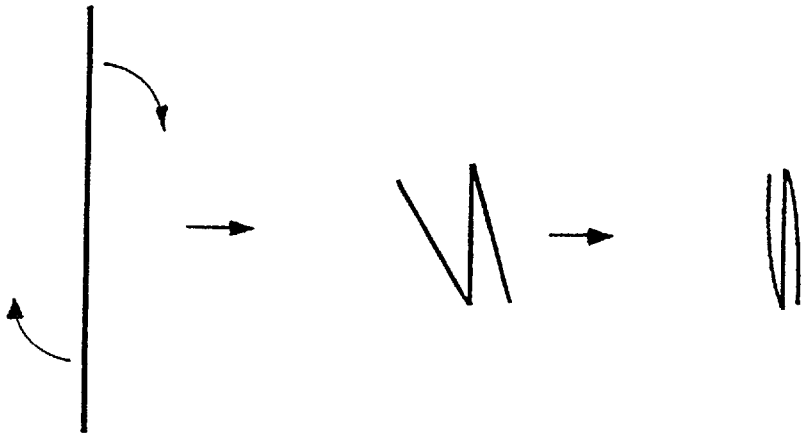
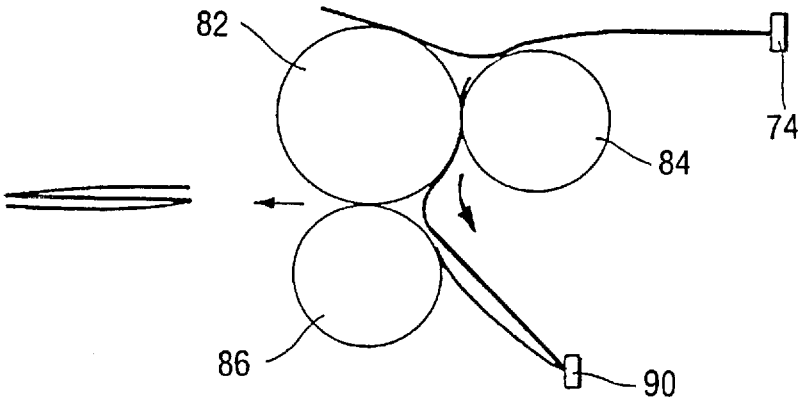
FIG. 6A

MAILING SYSTEM CONTROLLED BY THE COMPUTER SOFTWARE

TECHNICAL FIELD

This invention relates to a printing and post-processing system and more particularly to an integrated on-line printing and inserting system used at the workplace and a method of controlling the same by the computer with program, and more particularly to a mailing system controled by computer software.

BACKGROUND ART

In the daily office works, the mail sheet is usually folded and then inserted into the envelope manually with unpleasant and time consuming task. To print a one-page letter, assemble and fold it, insert it into an envelop and close it, takes at least 30 seconds of working time. An extra enclosure takes even longer. Printing is far less time-consuming than the post-processing. Often, small inserter systems are not welcome as they are not flexible enough and from their image and noise, they are rather belong into the mail room. Big inserters require a lot of space and specially trained personnel. They only pay off with high mail throughputs. Often, one would like to send a mailing to the customers, but one would hesitate because of the effort to be taken.

So far, printers and inserters are separately on the market and, if at all, they are mostly used in different parts of the companies. Their purpose, however, is closely linked. An integration of these functions meets the demands of the users in a very useful way.

To solve various drawbacks and inconveniences, mail processors have been proposed. For instance, U.S. Pat. No. 5,301,935 discloses an apparatus for inserting a sheet into an envelope and sealing the latter with a reverse roller disposed in an envelope-feed path connected to a hopper for stacking envelopes and a means for inserting the sheet into the envelope where the reverse roller operates to turn over the envelope-feed path for simplifying conveyance of the envelope with reduction of size of the apparatus, notwithstanding the apparatus is not controlled by any computer program for selectively operating the apparatus for example to print or not print the sheet, to insert or not insert the sheet into the envelope and to enclose or not enclose the enclosure and for processing various accidents or jams nor provided with any means for supplying enclosures under control of the computer with program.

It is, therefore, an object of the invention to provide a novel printing and post-processing system operable and controllable by the computer with software program.

It is another object of the invention to provide a novel printing and post-processing system selectively operable by the computer program to print or not print sheet, to insert or not insert the sheet into an envelope and to enclose or not enclose the enclosure.

It is a further object of the invention to provide a novel printing and post-processing system which performs several different operations under the control of the computer with software programs by only inputting commands or parameters to the system, i.e. from simple printing for internal documentation, listings and copies, up to manually signed, personal mailings with inserted enclosures.

It is yet a further object of the invention to provide a novel printing and post-processing system operable with ease and without any special education or training even at very low noise.

It is a still further object of the invention to provide a novel method of controlling a printing and post-processing automatically operable under the control of the computer with software programs without any help by the user.

Finally, it is an object of the present invention to provide a novel mailing system controlled by computer software.

The above and other objects, features and advantages of the present invention will be apparent from the following descriptions. In accordance with the invention, there is provided a printing and post-processing which performs selectively several operations under the control of the computer with software programs by previously inputting commands and parameters to the system.

DISCLOSURE OF INVENTION

The printing and post-processing according to the invention comprises a computer unit for instructing and controlling the system as a whole, a printer associated through a controller unit with the computer unit for selectively printing a sheet to be mailed, a transfer unit connected to the printer with a manual tray for transferring the sheet to a folding position by the programmed instructions and under actuation with a sensor, a folding unit connected in series to the transfer unit for folding and feeding the sheet by the programmed instructions and under actuation with another sensor, a conveyor unit arranged in association with the folding unit for conveying the folded sheet with a selectively added enclosure to an insertion position, an enclosure feeding unit associated with the conveyor unit for selectively supplying an enclosure to the conveyor unit for addition to the sheet by the programmed instructions and under actuation with a further sensor, an envelope tray unit associated with the conveyor unit for stacking a plurality of empty envelopes and feeding the same by piece with a means for engaging with and turning over a flap of the envelope, an insertion unit arranged between the conveyer unit and the envelope tray unit for introducing the sheet into the envelope and subsequently transferring the enclosed envelope to a sealing position, a sealing unit associated with the insertion unit for damping a gummed portion of the flap of the envelope and closing the flap for sealing and a receiver unit disposed in abutting relation to the sealing unit for receiving and storing the sealed envelopes.

The controller unit is essentially comprised of a printer controller for controlling the printing operation of the printer, an inserter controller for controlling the sheet folding, the sheet transfer, the sheet insertion into the envelope, the envelope sealing as well as the finished envelope deposit in the receiver unit and a host controller connected to the computer unit wherein the printer controller and the inserter controller are interactively communicated with each other for enabling whole control of the system.

The transferring unit may include a mechanism for selectively transferring the sheet to the folding unit. The mechanism for selectively transferring the sheet to the folding unit comprises a manual tray for manually stacking and automatically transferring the sheet to the folding unit, a coupling means connected to an output of the printer for automatically transferring the printed sheet to the folding unit, and a path means with feed rollers for feeding the sheet to the folding unit, one terminal of which is branched into two ways with feed rollers for connecting to the manual tray and the coupling means respectively whereas the opposite terminal thereof is connected to a first stopper means of the folding unit for determining the holding position of the sheet.

The folding unit provides an accumulation means communicated with a path means of the transfer unit for receiving and accumulating one or more sheets, a first automatic and programmable adjusting means movably connected to the accumulation means and a guide roller means operatively associated with the accumulation means for guiding and folding the sheet in cooperation with a second automatic and programmable adjusting means movably connected to the guide means.

The folding unit further operates in selection two fold modes of a wrap fold and a Z-fold of the sheet by varying positions of the first and second adjusting means, wherein parameters such as the type of folding (wrap fold and Z-fold) and sheet size adjustment are controlled by the inserter controller with software programs.

The conveyor unit comprises a first running belt system with a main driving roller, guide rollers and a belt suspended therearound and associated with to the enclosure supplying unit for conveying the enclosure and a second running belt system having a driving roller and driven guide rollers and a belt suspended therearound and partially made into contact with the belt of the first running belt system for passing therethrough the folded sheet and the enclosure selectively added.

The second running belt system is provided with a hook means for temporarily catching the enclosure for synchronizing the feeding of the folded sheet and a sensor for detecting an arrival of the folded sheet to activate the hook member for retraction.

The envelope tray unit includes a tray body automatically elevated by an elevator means for superimposing therein a plurality of envelopes, a nail member resiliently supported by a crank arm for engaging with and turning over the flap of the envelope and a set of feed rollers for feeding the envelope by piece to the insertion unit including a guide roller which is resiliently in touch with the top envelope superimposed.

The envelop tray unit further includes means for detecting the sizes of the envelope and the flap thereof superimposed on the tray body.

The insertion unit provides two feed rollers disposed symmetrically for feeding and subsequently somewhat moving back an empty envelope to a receiving position of the folded sheet for insertion therein. A claw means operable to be inserted into an opening of the envelope for guiding the folded sheet and the additional enclosure into the envelope and a positioning means for placing the folded sheet in alignment with the envelope for smooth insertion of the sheet thereinto.

The insertion unit includes insertion rollers including a driving roller and guide rollers where the folded sheet is inserted into the envelope, a first envelope discharge chute communicated at its one end with the envelope tray unit and having therein an inclined path with a set of feed rollers for feeding the envelope against the insertion rollers, a guide segment disposed in abutment with an open end of the first envelope discharge chute and in confronting relation with the driving roller and having a guide surface curved along a partial circle of the driving roller with a specified clearance to provide a guide channel between the driving roller and the guide segment, a sheet holder disposed in the conveyor unit for suspending further passing of the folded sheet and holding the same in stand by before approaching to the insertion rollers and comprised of a hook member connected at its one end to a crank arm connected in turn to a plunger driven by a solenoid by instructions from the inserter controller, a second envelope discharge chute disposed in the down stream against the insertion rollers for once receiving the empty envelope passed through the insertion rollers, returning the same envelope against the insertion rollers for a predetermined distance to receive therein the folded sheet guided by the insertion rollers and then discharging the envelope inserted with the folded sheet against the sealing unit and providing a tilted path with confronting feed rollers, a sensor for detecting an arrival of the empty envelope in the second envelope discharge chute and sending a message of arrival to the inserter controller for instructing the insertion rollers to effect a short reverse rotation by which the envelope once received in the second envelope discharge chute is somewhat returned against the insertion rollers for the predetermined distance to receive therein the folded sheet and a claw arm member provided in an entrance of the second envelope discharge chute and having a tip end adapted to be inserted into an operating of the envelope just when returned for facilitating a smooth insertion of the folded sheet into the envelope and an aligner provided in the vicinity of the sheet holder for pushing the folded sheet to the position just in alignment with the opening of the envelope waiting to receive folded sheet therein.

The sealing unit comprises a first chute communicated to an outlet of the insertion unit for guiding an impregnated envelope therein and provided at its delivery end a flap bending comer to turn over the flap of the envelope, a damping means provided at the entrance of the first chute for wetting the gummed portion of the flap of the envelope and including a water tank, a water impregnating segment of foam and a water supply means disposed between the water tank and the water impregnating segment, swingable rollers arranged in a swingable crank confronted with the flap bending corner for receiving a closed end of the envelope and then moving the envelope somewhat outwardly, sealing rollers disposed in the vicinity of the swingable rollers for pressing and sealing the bent flap of the envelope, a turntable cam means arranged in contact with the swingable crank for swinging the swingable rollers under the function of a spring means and a second chute to be formed with an elongated arm member of the swingable crank for feeding the sealed envelope into the receiver unit.

The sealing unit provides a detection means for detection of an arrival of the envelope, a damping means for applying a water to a gummed portion of the flap of the envelope in response to the detection of arrival of the envelope, and a water level measurement means for measuring a water level in a water tank and issuing a warning of exceed over the admissible low level.

The sealing unit is composed of a first guide chute having therein an inclined path and provided at its inlet portion with a movable damping means including a support member for bearing a wet foam piece connected to a water supplier and its outlet portion with a sensor sensible to receipt of the envelope in the inclined path for sending a message to the inserter controller to instruct the damping means a projection of the wet foam piece against the flap of the envelope for wetting, a set of the guide rollers swingably arranged with a swing crank member having a crank arm for once receiving in the biased position the envelope sent through the path of the first guide chute and then feeding in the vertical position the envelope against the sealing position, sealing rollers for receiving with press the envelope and sealing the wet gummed flap to the envelope body and a cam mechanism disposed in engagement with the swing crank member to provide a swing motion thereof and including a cam piece and a solenoid connected thereto and a second guide chute which is formed when the crank arm of the swing crank member is turned to the vertical position to provide a vertical path and provided with a sensor for detecting a passing of the sealed envelope through the vertical path to activate the receiving unit.

The receiver unit includes a first chamber for receiving the sealed or unsealed envelope fed from the sealing unit, an upstanding support wall movably arranged in the chamber for supporting the envelope vertically in right order, a rotary pushing member disposed in juxtaposition to the support wall for pressing the envelopes thereagainst, and a second chamber for storing the enclosures and associated with feed rollers for selectively supplying the enclosures to the conveyor unit to accompany with the folded sheet.

The rotary pushing member comprises two rotary discs arranged in the confronting relation, each disc providing with spaces four upstanding rod members for progressively pressing the envelope upon rotations of the discs.

The receiver unit is provided with an envelope monitor means for monitoring the volume of the envelopes stored therein. And commanding to display an exceed over an admissible volume of the envelopes to be stacked in the receiving unit.

The receiver unit and the enclosure supplying unit are slidably accommodated in a common casing for open and close to take the envelopes and/or the folded sheets out of the receiver unit and to fill the enclosure supplying unit with the enclosures to be inserted into the envelope.

Further, there is provided a printing and post-processing system comprising a first means for inputting data and commands necessary to control and operate the system, a second means for receiving the data from the first means for identification and sending the commands to the system for control, a third means for receiving the data from the second means to control a printing operation of the printer and to output an information including an operation state of the printer, a fourth means for receiving the data from the second means to control the folding, transferring and inserting operation of the sheet and also the sealing and depositing operations of the envelope and then to output an information including operational states in respective steps, a fifth means contained in the first means for receiving the data from the third and fourth means to monitor the printing operation and output an information including an operational status of the system, a sixth means contained in the first means for receiving the data from the fifth means to display and a seventh means contained in the first means for receiving the data from the sixth means to select an operation mode of the system for a printing mode, an inserting mode or a printing and inserting mode and to send a selection signal to the second means.

The printing and post-processing system comprises a further means associated with the third means for switching an output of the printer from a face up output to a face down output used for only printing or diverting the sheet and vice versa.

The printing and post-processing system comprises another means associated with the fourth means for controlling operations to print or not print the sheet, to insert or not insert the sheet into the envelope, to enclose or not enclose the enclosure and to seal and not seal the flap of the envelope.

The printing and post-processing system comprises a still further means associated with the fourth means for detecting and warning an emptiness of the envelope in the envelope tray unit.

The printing and post-processing system comprises yet a further means associated with the second means to select a manual supply of the sheet to be mailed, means associated with the first means for commanding through the sixth means to select the folding modes for a wrap fold mode or a Z-fold mode and to send a selection signal to the second means, means associated with the fourth means for commanding an accumulation of the sheet fed from the manual sheet supply means by counting the number of pieces accumulated therein and detecting an exceed over permissible number of accumulation for warning, means associated with the fourth means for commanding the folding means to perform selectively the wrap fold mode or the Z-fold mode, means associated with the fourth means for commanding a feed of the sheet to the receiver unit free of enclosure when the wrap fold mode is selected, means associated with the fourth means for detection of the presence of enclosures deposited in the box, means associated with the forth means for commanding a conveyance of the enclosure to the insertion means for introduction into the envelope together with the sheet and means associated with the fourth means for sealing and transferring the envelope to the receiver unit.

The printing and post-processing system comprises a further means associated with the third means for commanding the printer control means to input a desired number of the sheet to be printed, means associated with the third means for commanding a connection of the face up output of the printer to the folding means, means associated with the first means for commanding through the sixth means to select the folding modes for a wrap fold mode or a Z-fold mode and to send a selection signal to the second means, means associated with the fourth means for commanding an accumulation of the sheet fed from the printer by counting the number of pieces accumulated therein and detecting an exceed over permissible number of accumulation for warning, means associated with the fourth means for commanding the folding means to perform selectively the wrap fold mode or the Z-fold mode, means associated with the fourth means for commanding a feed of the sheet to the receiver unit free of enclosure when the wrap fold mode is selected, means associated with the fourth means for a detection of the presence of enclosures deposited in a box, means associated with forth means for commanding a conveyance of the enclosure to the insertion means for introduction into the envelope together with the sheet and means associated with the fourth means for sealing and transferring the envelope to the receiver unit.

The printing and post-processing system comprises an additional means associated with the third and forth means for commanding detection of the sheet jam and an output of the warning notice for computer display, means associated with the third means for commanding discontinue of the printing operation and switching the operation into the face down output operation upon detection of the warning notice with subsequent discharge of the sheet to the face down tray and means associated with the first means for commanding restart of the printer after removal of the sheet jam.

Furthermore, there is provided a method for controlling a printing and post-processing system, which comprises steps of selecting one of three operation modes of printing, inserting and printing with inserting, processing in case the printing mode is selected the data in the printer for printing on the sheet with selection to continue or discontinue or divert the printing operations, manually inserting in case the inserting mode is selected by software the sheet into the manual tray for preparation of transferring the sheet to the folding unit, predetermining a desired number of sheet to be enclosed in an envelope, displaying a warning notice when an admissible volume of the sheet to be enclosed in the envelope is exceeded, selecting a mode of the folding into a wrap fold mode when an enclosure is desired to be enclosed with the sheet, verifying one piece of the sheet to be folded in the wrap mode, sending a warning notice when more than one piece of the sheet entails and folding the sheet and feeding the same with the enclosure into the receiver unit, selecting a Z-fold mode by software when an insertion of the sheet into the envelope is desired, transferring the sheet to an accumulation means, taking the sheet out of the accumulation means, folding with rollers and subsequently transferring the folded sheet to the insertion means, inserting the sheet into the envelope, feeding the inserted envelope to the sealing means by wetting a gummed flap of the envelope, closing and sealing the flap of the envelope, and feeding the sealed envelope to the receiver unit, setting in case the printing with inserting mode is selected a desired number of sheet to be printed and inserted into the envelope, setting the printer to transfer the printed sheet to the accumulator, accumulating the sheets to be folded, folding the sheet with rolls and transferring the folded sheets to the insertion means, selecting a wrap fold mode when an enclosure is desired to be inserted, verifying presence of a piece of the sheet to be folded in the wrap mode, sending a warning notice to the computer when the sheet in the wrap mode exceeds over one limited piece and folding the sheet and feeding the same with the enclosure to the receiving unit, selecting a Z-fold mode when an insertion into an envelope is not desired, accumulating the sheet in the accumulator, taking the sheet out of the accumulating means, folding the sheet with rolls, conveying the folded sheet to the insertion means, inserting the sheet into the envelope, feeding the enclosed envelope to the sealing means by wetting a gummed flap of the envelope, closing and sealing the flap of the envelope and feeding the sealed envelope to the receiving unit.

The insertion mode includes further a step of detecting the presence an enclosure in the box and feeding the enclosure to the folded sheet.

The insertion mode includes further a step of detecting a volume of the envelopes stored in the receiving unit to issue an warning notice by displaying on the computer monitor when the envelopes exceed an admissible volume.

The printing and inserting mode includes the steps of detecting a volume of the sheet accumulated in the accumulating means, issuing a warning notice when the sheets exceed an admissible volume, instructing the printer to discontinue or divert printing of the sheet remained therein and also the transferring unit to discontinue further feed of the sheet to the accumulating unit.

The method of controlling the printing and post-processing system comprises further the steps of checking an operational state of the printing means when the sheet jam occurs, switching an activation of the printer to a face down output to print the remaining data in the sheet after the printing operation is discontinued and when the printing process is not completed, holding discontinuing state of the printing operation before receiving the next data for operation when a last piece of the sheet is still remained in the printer for printing and instructing the printer to restart after the sheet jam is removed.

BRIEF DESCRIPTION OF DRAWINGS

FIG. 5A is a partially enlarged schematic view showing a folding operation by the folding unit of the system according to the present invention.

FIG. 5B is a schematic view illustrative of the folding mode of the wrap fold to be achieved by the folding unit as shown in FIG. 5A.

FIG. 6A is a partially enlarged schematic view showing another folding operation by the folding unit in different operation from that of FIG. 5.

FIG. 6B is a schematic view illustrative of the folding mode of the Z-fold to be achieved by the folding unit as shown in FIG. 6A.

BEST MODE FOR CARRYING OUT THE INVENTION

Preferred but not imitative embodiments of the present invention will hereinafter fully be described in detail with reference to the accompanying drawings.

An embodiment of the printing and post-processing system according to the present invention will now be described with reference to the drawings.

Figure 1:
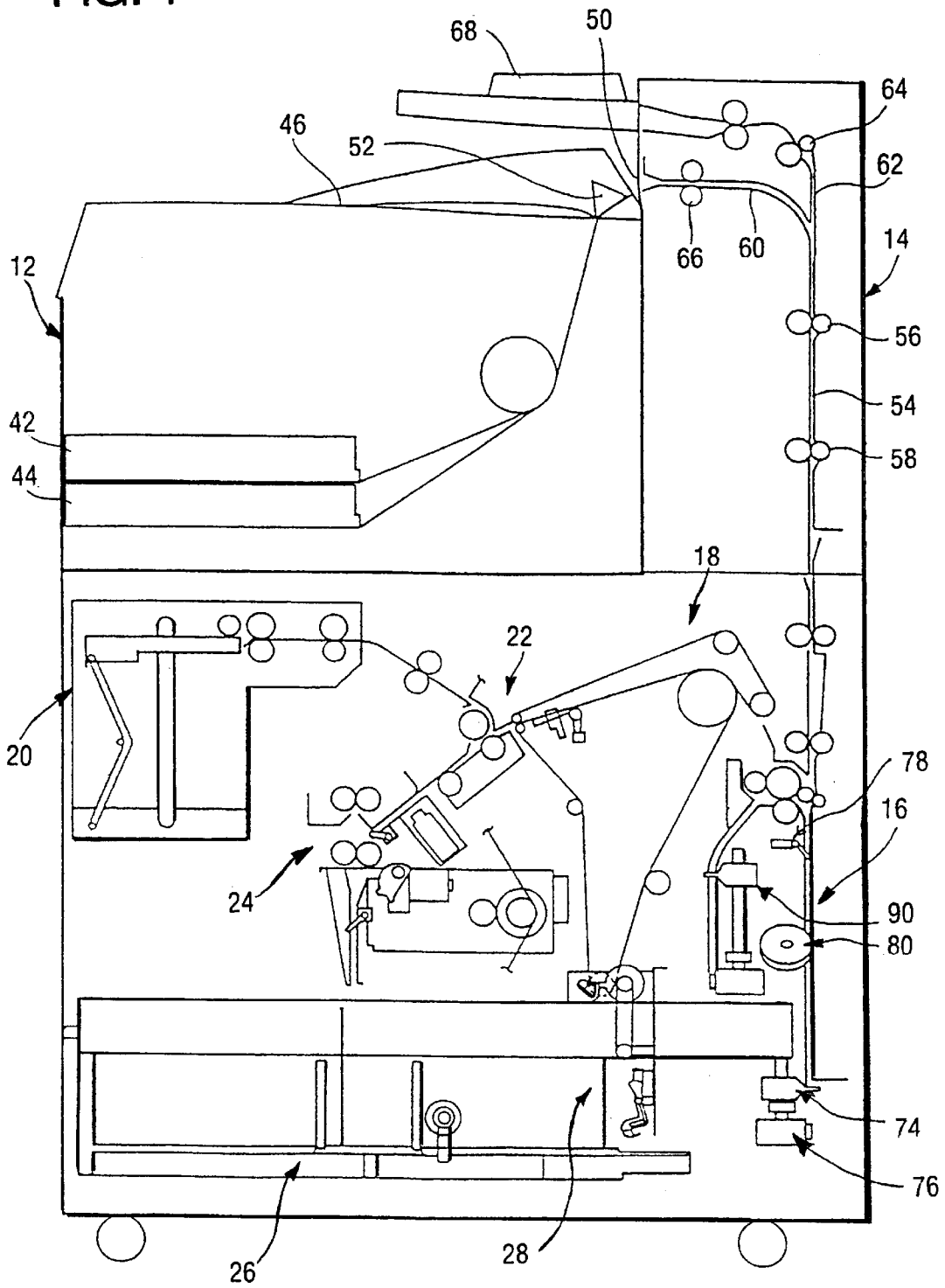
FIG. 1 is a schematic elevation showing an internal arrangement of a printing and post-processing system of an embodiment according to the present invention.

Referring to FIG. 1, the printing and post-processing system according to the invention is substantially comprised of a computer unit 10 for inputting the data and commands to each component of the system for selective and controlled operations, a printer unit 12 selectively operable with program to print the sheet to be mailed, a transfer unit 14 for feeding the sheet to an inserter unit, a transfer unit 14 for feeding the sheet to the inserting unit, a folding unit 16 for folding the sheet with different folding modes including the wrap and Z form foldings as hereinafter described, a conveyor unit 18 for conveying the folded sheet with a selectively added enclosure to the enveloping or storing position, an envelope tray unit 20 for stacking a plurality of envelopes and discharging the same by piece, an inserter unit 22 for receiving the envelope and then the folded sheet for subsequent insertion thereinto, a sealing unit 24 for sealing a flap of the envelope, a receiver unit 26 for receiving and storing the sealed envelopes therein, an enclosure supplying unit 28 for selectively supplying an enclosure to the conveyor unit 18.

Figure 2:
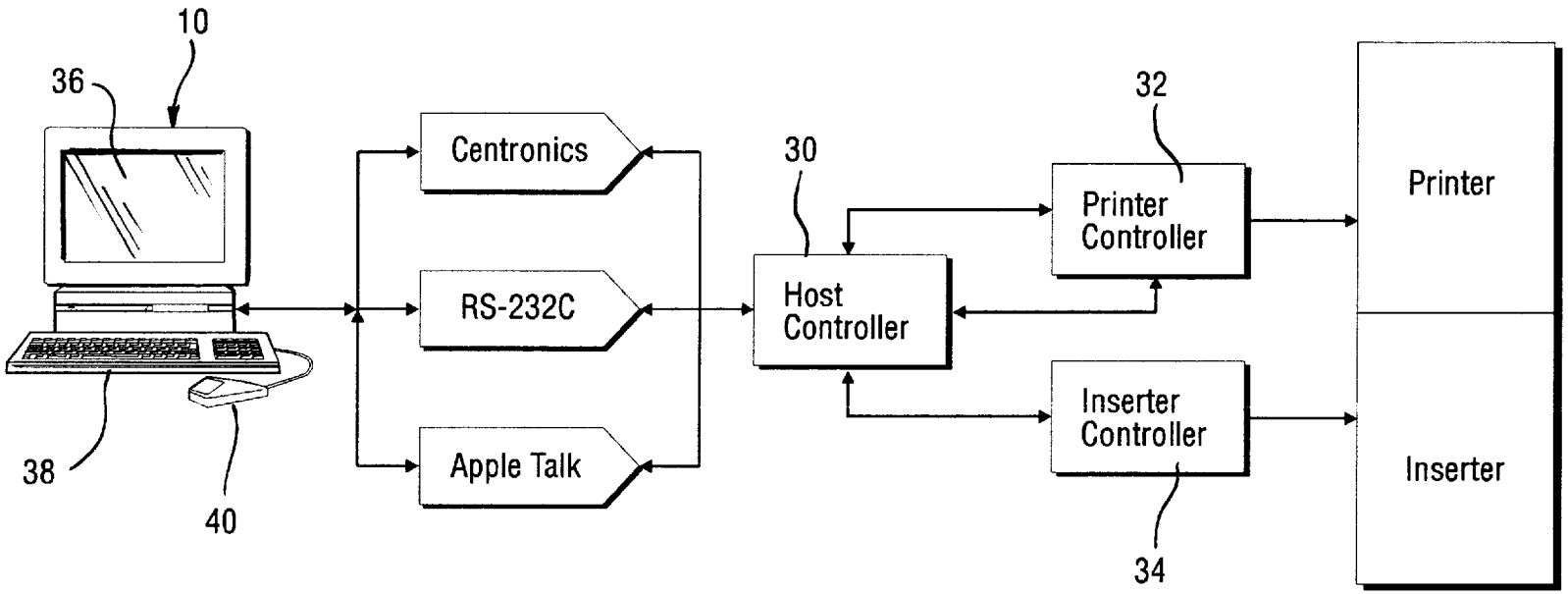
FIG. 2 is a block diagram showing a control system for the printing and insertion units according to the present invention.

In FIG. 2, there are arranged multiple controllers in the printing and post-processing system, for example, a host controller 30 connected to the computer unit 10, a printer controller 32 connected to the host controller 30 and an inserter controller 34 connected to the host controller 30.

The computer unit 10 commands and controls with programs the printing and post-processing system as a whole and provides a monitor 36, a keyboard 38 and a mouse 40. The computer 10 is connected to the printing and post-processing system through such connectors as IEEE1284 (Centronics), RS-232C (DB9) or Local Talk (Mini-DIN). Any type of the personal computers are available for this printing and post-processing system. In the proposed system, the computer is the most important component to which various commands are input to operate each component of the system and display the operating status of each component of the system on the monitor 36.

The printer controller 32 is physically connected through the host controller 30 to the computer 10. The printer controller 32 serves to control the print job of the printer 12 which works when the sheet is desired to be printed but does not work when the sheet has already been printed or the printing is not required.

The host controller 30 serves to monitor the operational status of the printer 12, the transfer unit 14, the folding unit 16, the conveyor unit 18, the envelope tray unit 20, the insertion unit 22, the sealing unit 24, the receiver unit 26 and the enclosure supplying unit 28. The host controller 30 corrects operational data such as the paper jam and sends a message to the computer 10, the printer controller 32 and the inserter controller 34 so that the printer controller 32 and the inserter controller 34 may communicate interactively with one another through the host controller 30.

The inserter controller 34 serves to control with program an operation of each component of the system including the transfer unit 14, the folding unit 16, the conveyor unit 18, the envelope tray unit 20, the insertion unit 22, the receiver unit 26 and the enclosure supplying unit 28. The inserter controller 34 further serves to control each mechanical operation in each component of the system and detects such undesired trouble as paper jam in the component to issue a message against the host controller 30.

Again in FIG. 1, the printer 12 is arranged on the head of the system and in abutment relation with the transfer unit 14. The printer 12 is preferably a laser printer with two cassettes 42, 44 having a paper holding capacity of 250 to 500 sheets. The printer 12 applied in the system according to the invention is selectively operated to print out the sheet as a so called face down output into a tray 46 for printing only or to print out the sheet as a so-called face up output into an inlet 50 of the transfer unit 14 for inserting the sheet into the envelope under the switching control of a switch member 52 with a solenoid.

Figure 3:
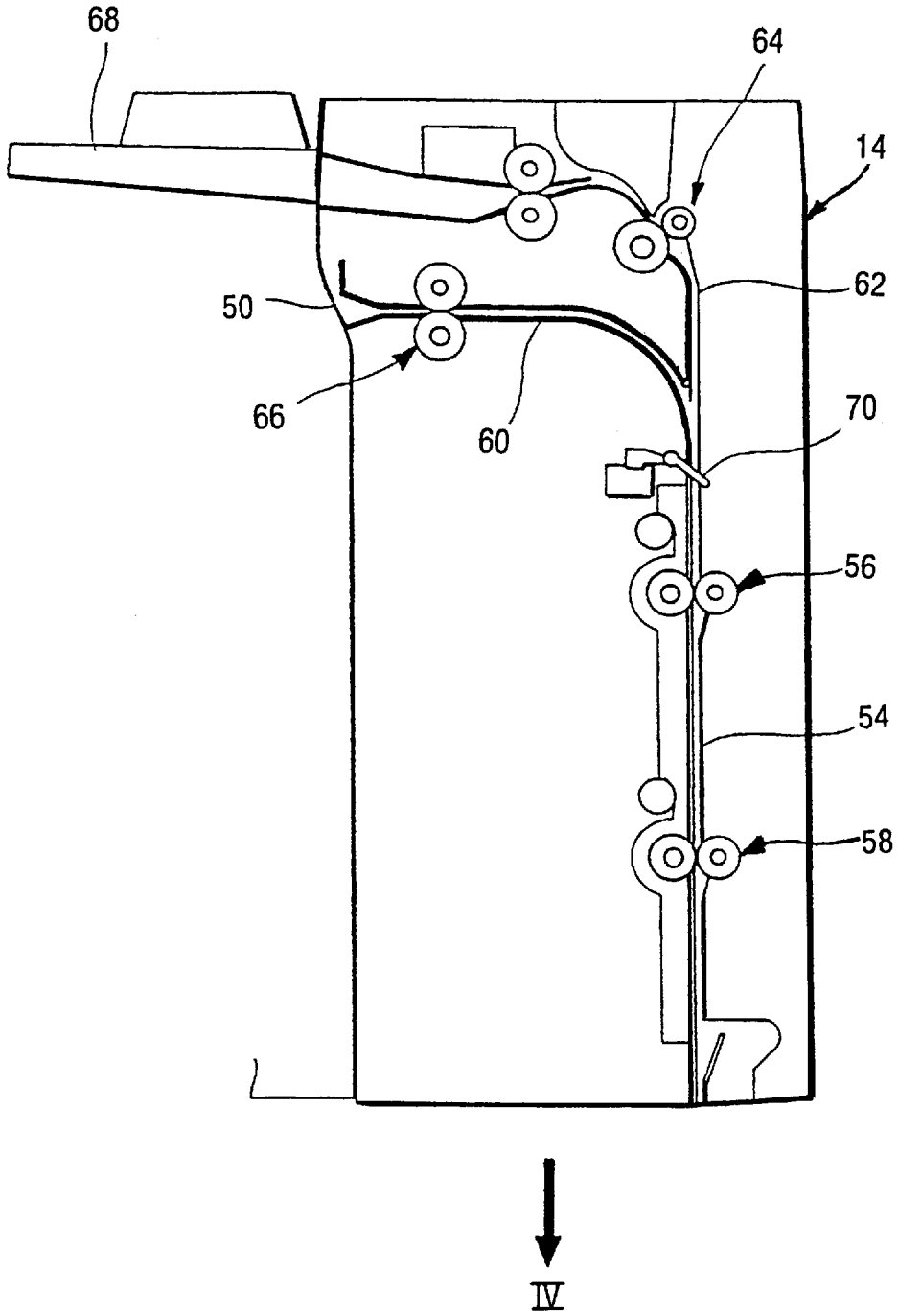
FIG. 3 is a schematic elevation of the transfer unit of the system according to the present invention.

In the transfer unit 14 as shown in FIG. 3, there is provided a feed path 54 with feed rollers 56 and 58 for feeding the sheet to the folding unit 16. A terminal end of the feed path 54 is branched into two feed paths 60 and 62 provided with feed rollers 64 and 66 respectively. The feed path 62 is connected to the manual tray 68, while the feed path 60 is terminated at the inlet 50. In the feed path 54, there is arranged a sensor 70 connected to the inserter controller 34 for sensing the passing number of the sheets and also an accidentally occurable paper jam.

Figure 4:
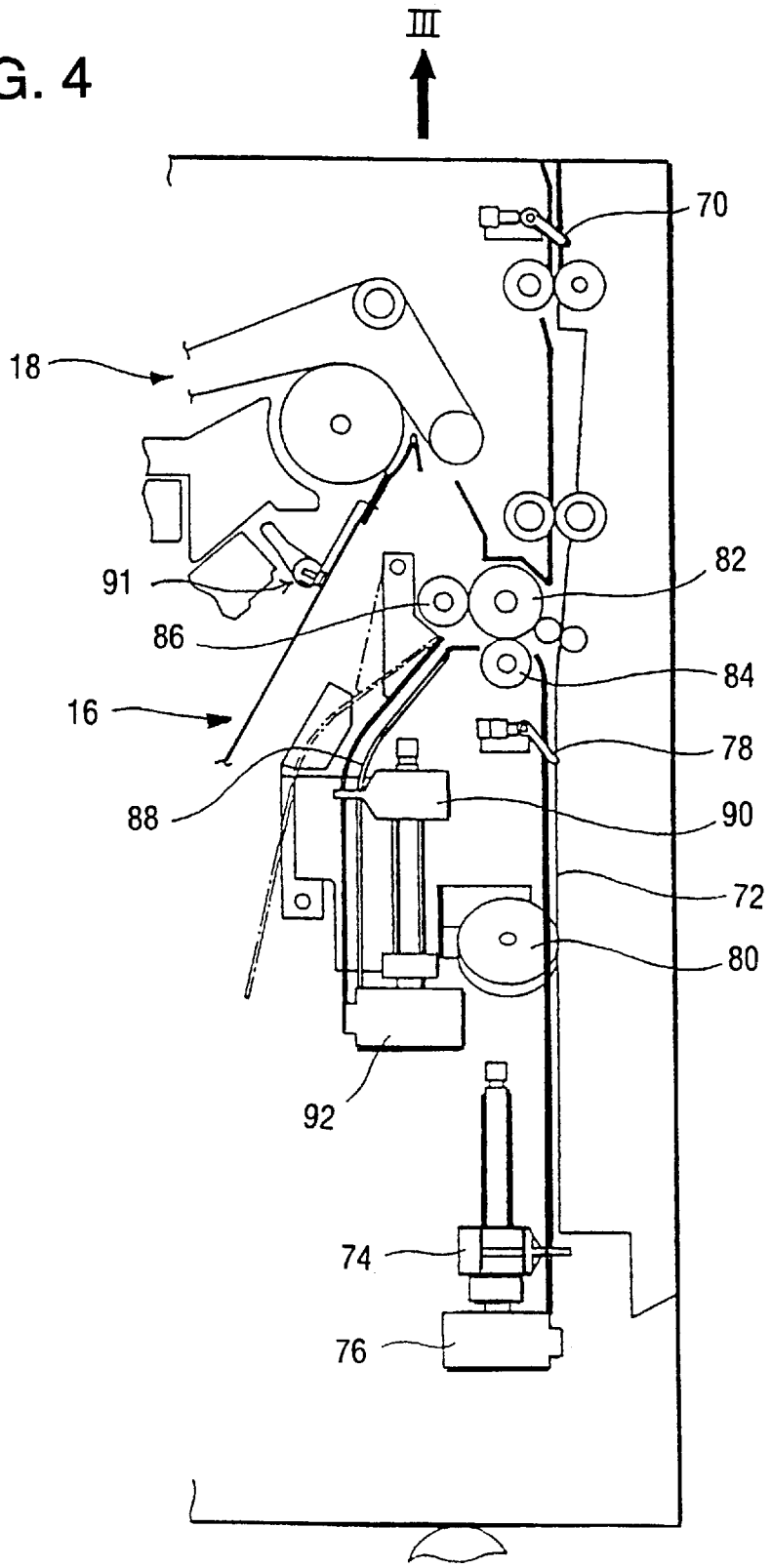
FIG. 4 is a schematic elevation of the folding unit of the system according to the present invention.

Referring to FIG. 4, the folding unit 16 is associated in series with the transfer unit 14 for accumulating, folding and feeding the sheet by receiving commands from the inserter controller 34. The folding unit 16 provides an accumulator 72 connected to the feed path 54 of the transfer unit 14 for receiving and accumulating the sheets. The accumulator 72 is designed to receive not more than five sheets for folding at a time.

The accumulator 72 is associated with a first adjuster 74 which is movably arranged to elevate by means of a motor unit 76 for adjusting a bottom level of the accumulator 72 in conformity with the sheet size and according to the folding modes of the wrap fold and Z-fold. An operation of the first adjuster 74 is controlled by the commands from the inserter controller 34 to meet the sheet size and selection of the folding modes by the user for the wrap fold mode and the Z-fold mode as hereinafter fully described.

The accumulator 72 is further provided with a sensor 78 which serves to detect the number of the sheets to be inserted into the accumulator 72 and the accidentally occurable trouble like a paper jam. For example, the sensor 78 sends the inserter controller 34 a warning notice when more than five sheets are inserted into the accumulator 72.

The accumulator 72 is furthermore provided with a positioning roller 80 for moving by its rotation the sheets to one side wall (not shown) of the accumulator 72 for alignment.

In FIGS. 5 and 6, a set of guide rollers 82, 84 and 86 are associated with the accumulator 72 for guiding and folding the sheet, namely, the sheet is taken out of the accumulator 72 and passed through the rollers 82 and 84 and then through the rollers 82 and 86 after once introduced into the guide pocket 88 as shown in FIG. 4, in which is arranged a second adjuster 90 to elevate by means of a motor unit 92 for adjusting a bottom level of the guide pocket 88 to meet the sheet size which has been previously input by the computer 10 as one of the data. An operation of the second adjuster 90 is controlled by the inserter controller 34 with programs.

As hereinbefore described, the system provides two different folding modes of a wrap fold and a Z-fold of the sheet by changing positions of the first adjuster 74 which will be described more concretely with reference to FIGS. 5B and 6B.

FIGS. 5A and 5B show the folding mode of wrap fold where the first adjuster 74 is moved upwardly by the motor unit 76 to shift the bottom level of the accumulator 72 against the roller 84 so that the sheet transferred from the transfer unit 14 is forced to bend at the one-third lower position of the sheet as shown in FIG. 5A.

The bent portion of the sheet is pinched between the guide roller 82 and the guide roller 84 for entering into the guide pocket 88 while bending again the sheet at the opposite one-third position of the sheet and then the latter bent portion is pinched between the guide roller 82 and the guide roller 86 for passing therethrough to provide a form of wrap folding as shown in FIG. 5B.

FIGS. 6A and 6B show the folding mode of the Z-fold where the first adjuster 74 is moved downwardly by the motor unit 76 to shift the bottom level of the accumulator 72 far from the roller 84 so that the sheet transferred from the transfer unit 14 is forced to bend at the one-third upper position of the sheet as shown in FIG. 6A. The bent portion of the sheet is similarly pinched between the guide roller 82 and the guide roller 84 for entering into the guide pocket 88 while bending again the sheet at the opposite one-third position of the sheet and then the latter bent portion is pinched between the guide roller 82 and the guide roller 86 for passing therethrough to provide a form of Z-folding as shown in FIG. 6B.

Figure 7:
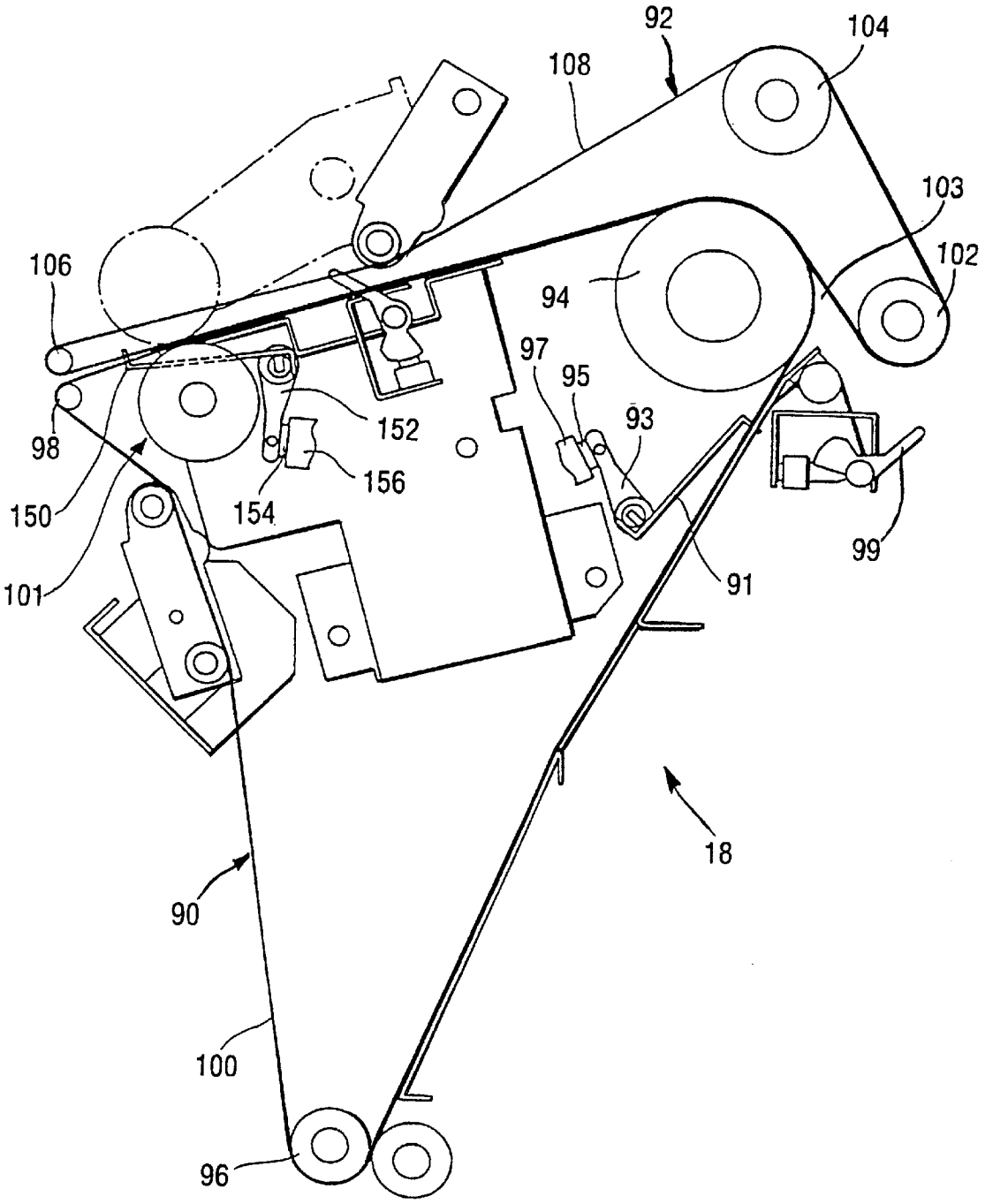
FIG. 7 is a schematic elevation of the sealing unit of the system according to the invention.

In FIG. 7, the conveyor unit 18 is arranged between the folding unit 16 and the inserter unit 22 for conveying the folded sheet with a selectively added enclosure to the insertion unit 22. The conveyor unit 18 provides two running belt systems 90 and 92 cooperatively arranged. The running belt system 90 is provided into a substantially triangular form with a main driving roller 96, guide rollers 94 and 98 and a belt 100 suspended therearound, while the running belt system 92 is arranged into a substantially crank form with a driving roller 102 and driven guide rollers 104 and 106 and a belt 108 suspended therearound and partially made into contact with the belt 100 running on the guide roller 94 for passing therethrough the folded sheet and the enclosure selectively added by means of the running belt system 90.

The running belt system 90 is also provided with a hook member 91 connected at its one end to a crank arm 93 connected in turn to a plunger 95 driven by a solenoid 97 upon receipt of instructions from the inserter controller 34 for temporary stopping the enclosure for synchronizing the feeding of the folded sheet and a sensor 99 for detecting an arrival of the folded sheet to retract the hook member 91.

Further, the conveyor unit 18 is provided with a pair of feed rollers 101 for feeding the sheet and the added enclosure to the insertion unit 22.

Figure 8:
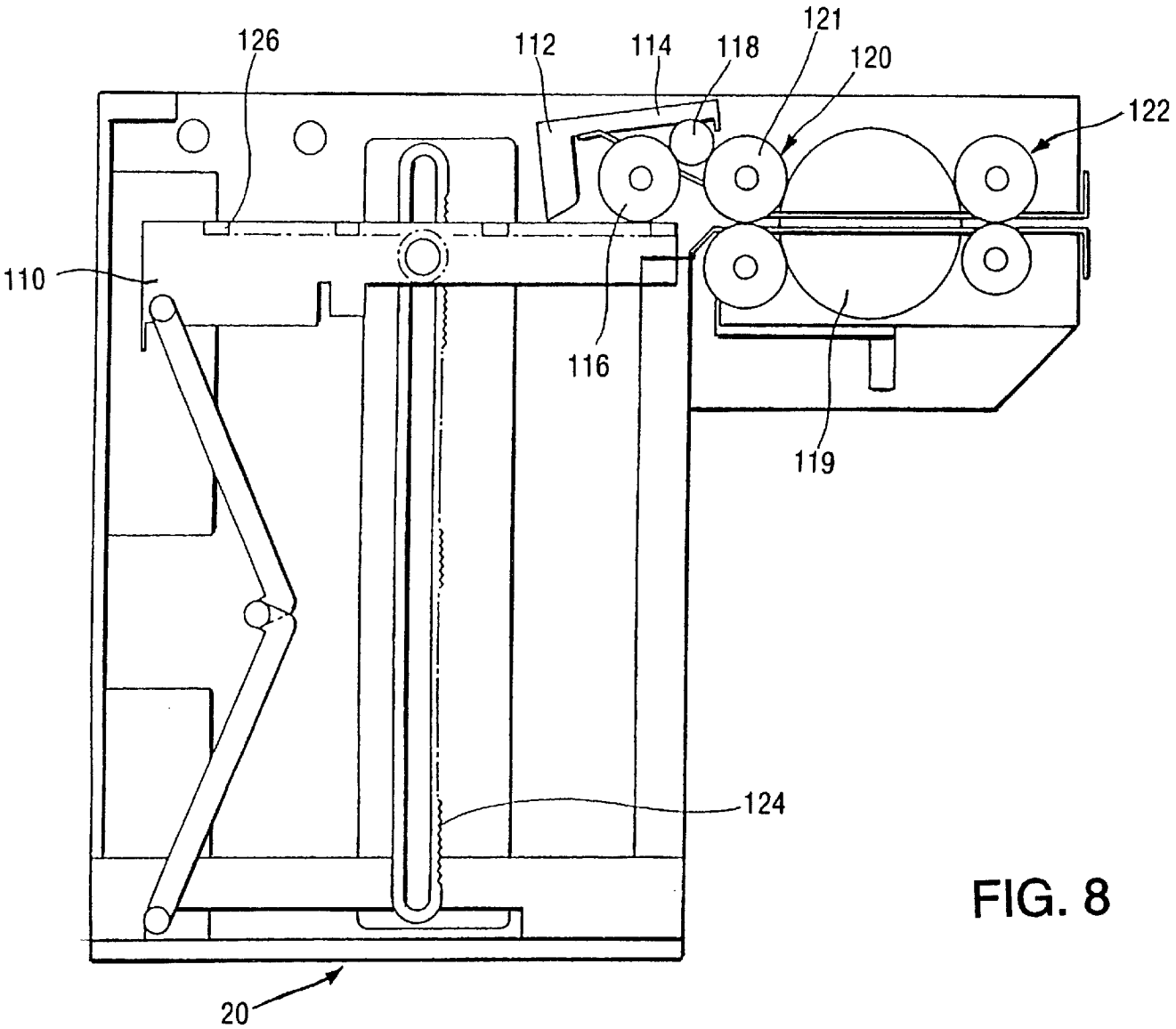
FIG. 8 is a schematic elevation of the envelope tray unit of the system according to the present invention.

In FIG. 8, the envelope tray unit 20 is comprised of a tray body 110 for superimposing therein a plurality of envelopes, a nail member 112 resiliently supported by a crank arm 114 for engaging with and turning over the flap of the envelope and a set of feed rollers for feeding the envelope to the insertion unit 22 including a guide roller 116 which is resiliently in tough with the top envelope superimposed, feed rollers 120, 122 symmetrically arranged and including a driving roller 121 and transmission rollers 118, 119 for engaging the guide roller 116 and the feed rollers 122 with the feed roller 120 respectively. The tray body 110 is automatically elevated by means of an elongated gear member 124 so that the guide roller 116 is kept in touch with the top envelope. The envelope is suitably provided with an address window.

In the envelope tray unit 20 there are arranged sensors 126 for automatically detecting the dimensions of the envelope and the flap. Since the system is applicable to the envelope formats of various type, the inserter controller 34 automatically identifies the envelope format in accordance with the result of the detection by the sensors 126 and controls each component of the system to meet the size of the envelope. When an envelope of irregular size is detected, the inserter controller 34 sends a message to the computer 10 for display on the monitor 36 and instructs the user to input dimensions of the envelope and the flap into the inserter controller 34 for memory.

In FIG. 1, the insertion unit 22 is disposed between the folding unit 16 and the envelope tray unit 20 and connected thereto through the conveyor unit 18 for inserting the sheet into the envelope and subsequently transferring the enclosed envelope to the sealing unit as hereinafter fully described.

Figure 9:
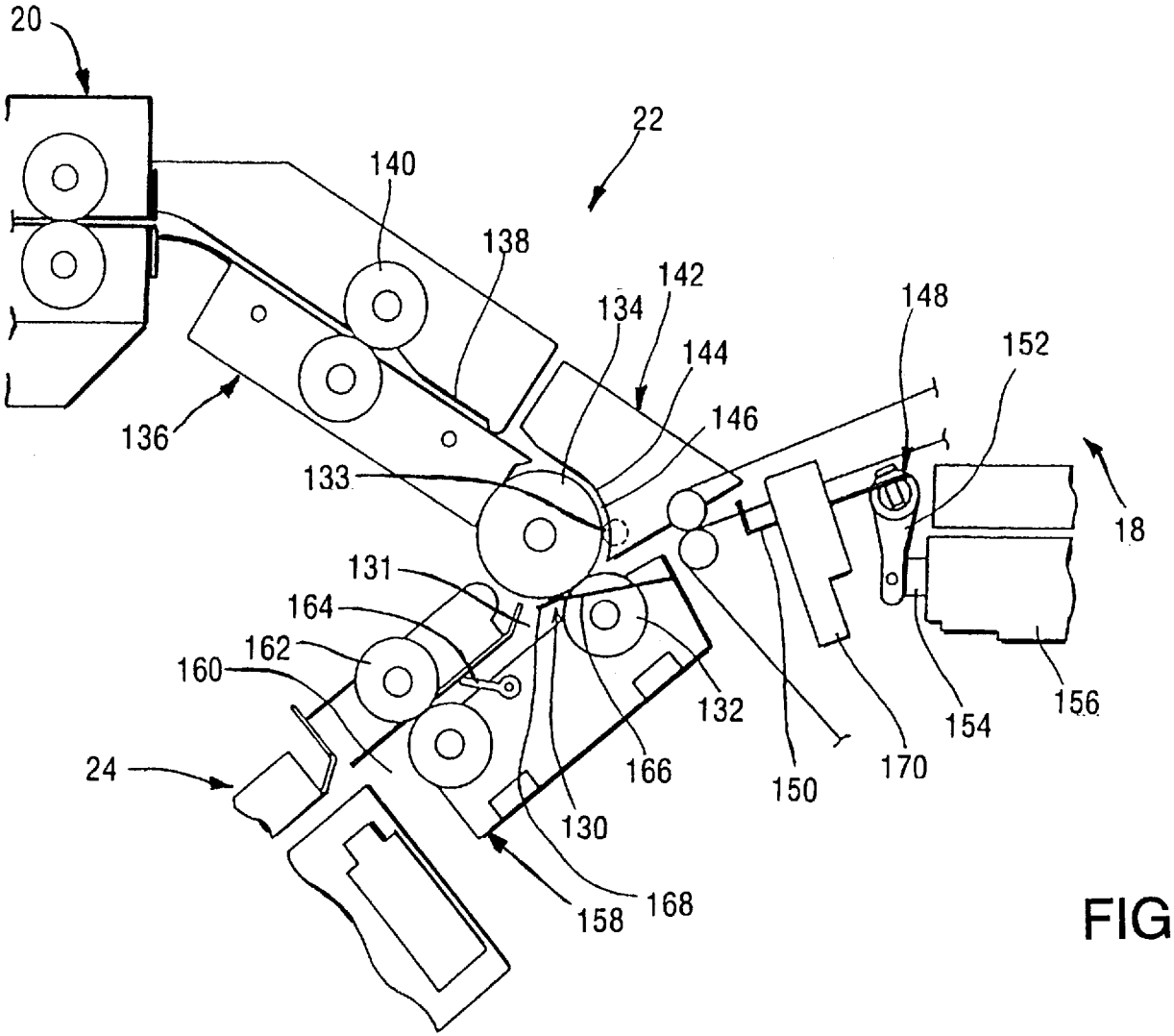
FIG. 9 is a schematic elevation of the insertion unit of the system according to the present invention.

In FIG. 9, the insertion unit 22 is composed of insertion rollers 130 including a driving roller 134 and guide rollers 132, 133 where the folded sheet is inserted into the envelope, a first envelope discharge chute 136 communicated at its one end with the envelope tray unit 20 and having therein an inclined path 138 with a set of feed rollers 140 for feeding the envelope against the insertion rollers 130, a guide segment 142 disposed in abutment with an open end of the first envelope discharge chute 136 and in confronting relation with the driving roller 134 and having a guide surface 144 curved along a partial circle of the driving roller 134 with a specified clearance to provide a guide channel 146 between the driving roller 134 and the guide segment 142, a sheet holder 148 disposed in the conveyor unit 18 as shown in FIG. 4 for suspending further passing of the folded sheet and holding the same in stand by before approaching to the insertion rollers 130 and comprised of a hook member 150 connected at its one end to a crank arm 152 connected in turn to a plunger 154 driven by a solenoid 156 by instructions from the inserter controller 34 and a second envelope discharge chute 158 disposed in the down stream against the insertion rollers 130 for once receiving the empty envelope passed through the insertion rollers 130, returning the same envelope against the insertion rollers 130 for a predetermined distance to receive therein the folded sheet guided by the insertion rollers 130 and then discharging the envelope inserted with the folded sheet against the sealing unit 24 and providing a tilted path 160 with confronting feed rollers 162, a sensor 164 for detecting an arrival of the empty envelope in the second envelope discharge chute 158 and sending a message of arrival to the inserter controller 34 for instructing the insertion rollers 130 to effect a short reverse rotation by which the envelope once received in the second envelope discharge chute 158 is somewhat returned against the insertion rollers 130 for the predetermined distance to receive therein the folded sheet and a claw arm member 166 provided in an entrance of the second envelope discharge chute 158 and having a tip end 168 adapted to be inserted into an opening of the envelope just when returned as hereinbefore described for facilitating a smooth insertion of the folded sheet into the envelope.

Further, when the folded sheet is inserted into the envelope, the guide roller 132 is intermittently rotated cooperatively with rotation of the feed rollers 101 of the conveyor unit 18 to feed the folded sheet for insertion into the envelope.

In the vicinity of the holder 148, there is provided an aligner 170 for pushing the folded sheet to the position just in alignment with the opening of the envelope waiting to receive folded sheet therein.

Again referring to FIG. 1, the sealing unit 24 is disposed in the down stream of the insertion unit 22 and associated with the receiver unit 26 for receiving the envelope enclosed with the folded sheet and the enclosure selectively added, sealing the flap of the envelope to the body thereof and feeding the sealed envelope to the receiver unit 26.

Figure 10:
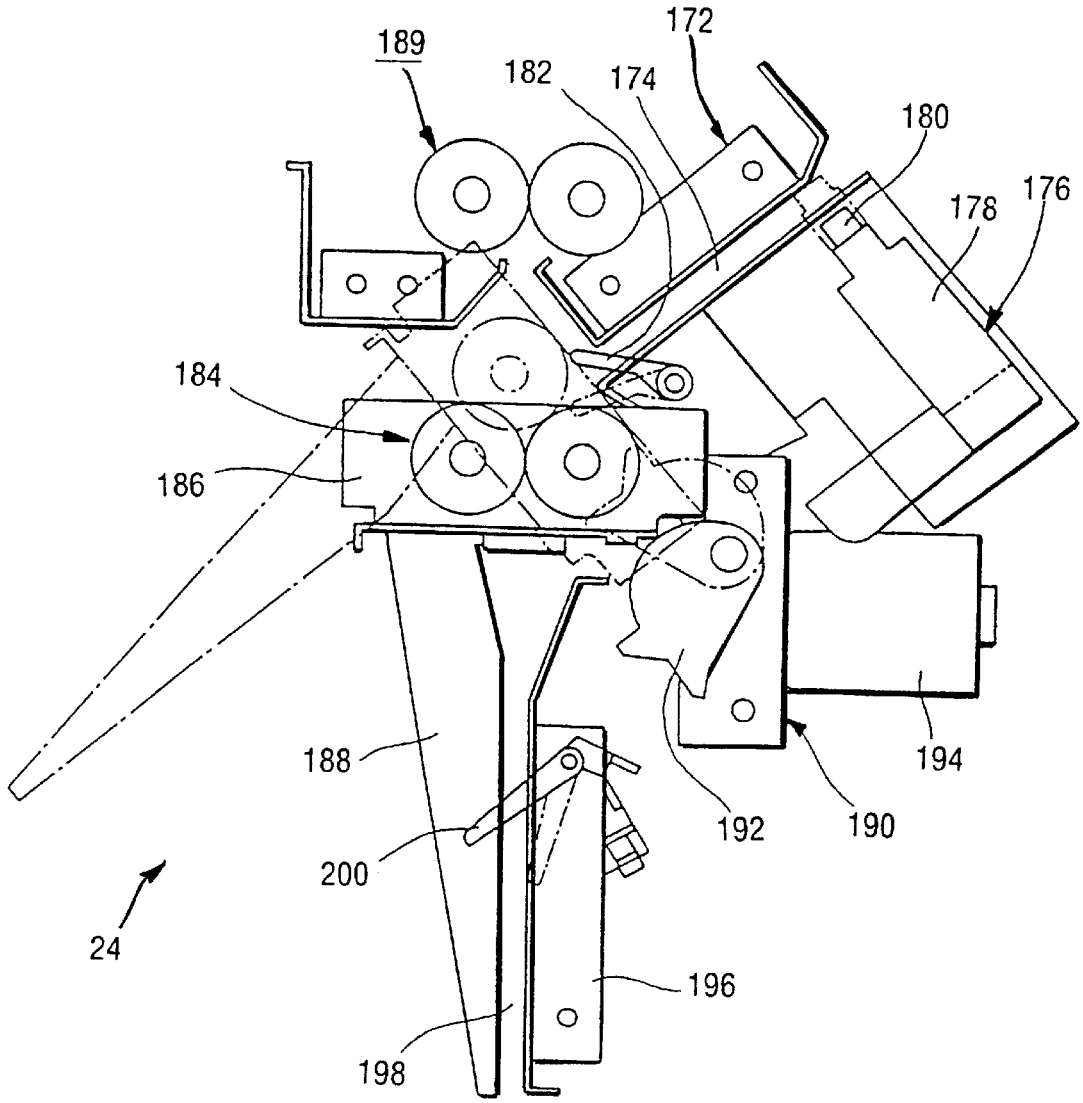
FIG. 10 is a schematic elevation of the sealing unit of the system according to the present invention.
Figure 11:
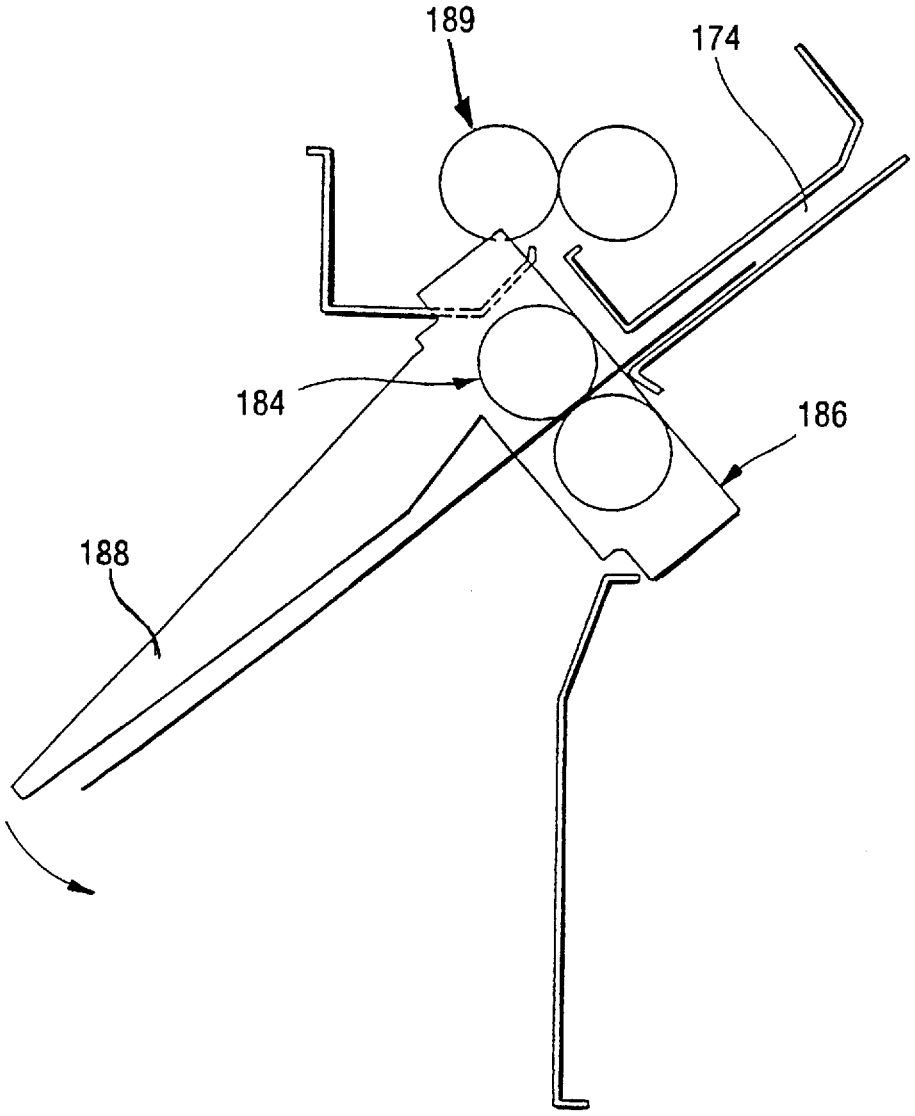
FIG. 11 is a schematic view of the sealing unit of the system in a position of receiving the opened envelope according to the present invention.
Figure 12:
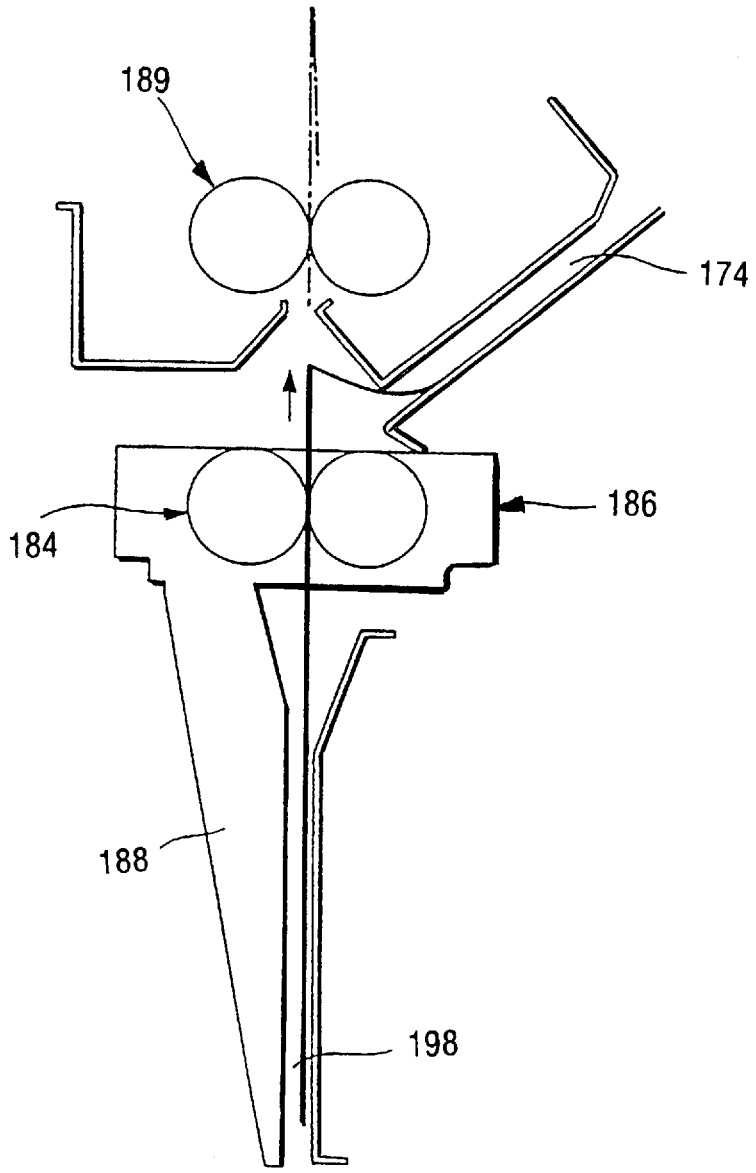
FIG. 12 is a schematic view of the sealing unit of the system in a position of feeding the closed envelope out of the sealing unit according to the present invention.

In FIG. 10, the sealing unit 24 is composed of a first guide chute 172 having therein an inclined path 174 and provided at its inlet portion with a movable damping means 176 including a support member 178 for bearing a wet foam piece 180 connected to a water supplier not shown and its outlet portion with a sensor 182 sensible to receipt of the envelope in the path 174 for sending a message to the inserter controller 34 to instruct the damping means 176 a projection of the wet foam piece 180 against the flap of the envelope for wetting, a set of the guide rollers 184 swingably arranged with a swing crank member 186 having a crank arm 188 for once receiving in the biased position as shown in FIG. 11 the envelope sent through the path 174 of the first guide chute 172 and then feeding in the vertical position as shown in FIG. 12 the envelope against the sealing position, sealing rollers 189 for receiving with press the envelope and sealing the wet gummed flap to the envelope body, a cam mechanism 190 disposed in engagement with the swing crank member 186 to provide a swing motion thereof and including a cam piece 192 and a solenoid 194 connected thereto and a second guide chute 196 which is formed when the crank arm 188 of the swing crank member 186 is turned to the vertical position to provide a vertical path 198 and provided with a sensor 200 for detecting a passing of the sealed envelope through the path 198 to activate the receiving unit 26.

In the system according to the invention, the envelope is always passed through the sealing unit 24 even when sealing is not desired and in that case the damping member 178 and the sealing rollers do not work under the control of the inserter controller 34 with the program.

Figure 13:
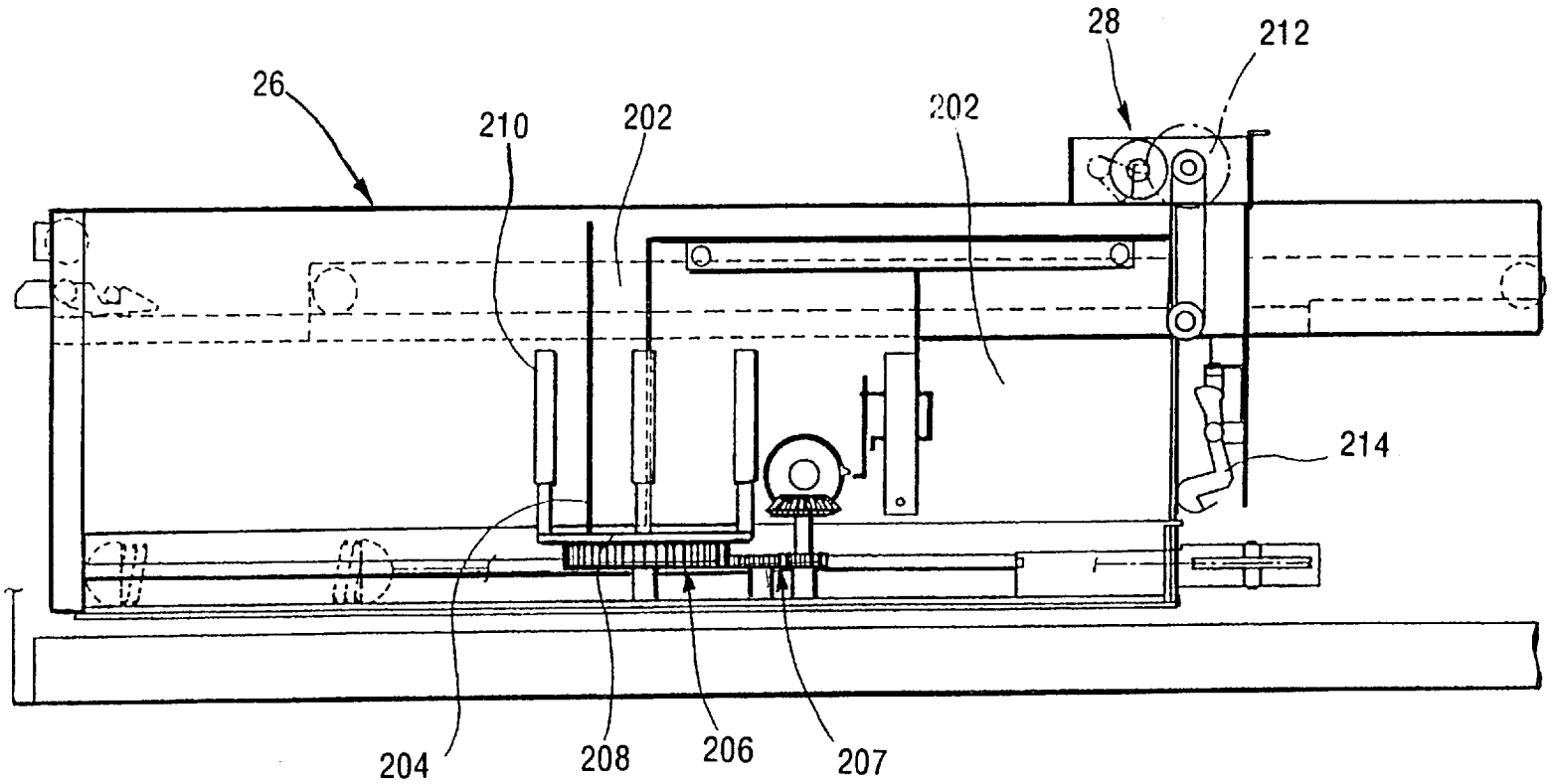
FIG. 13 is a schematic elevation of the receiver unit of the system and the enclosure supplying unit according to present invention.

In FIG. 13, the receiver unit 26 is disposed in the down stream of the sealing unit 24 for receiving and storing therein the sealed or unsealed envelopes or the folded prints.

The receiver unit 26 provides a first chamber 200 for receiving the sealed or unsealed envelope or the folded prints fed from the sealing unit 24 and a second chamber 202 for stacking therein the necessary enclosure.

In the first chamber 200, there is movably provided an upstanding support wall 204 for supporting the envelopes vertically in right order and rotary pushers 206 symmetrically arranged and rotated by means of a gear mechanism 207 to press the envelopes against the support wall 204. Each rotary pusher 206 comprises a rotary disc 208 providing thereon with spaces four upstanding rods 210 adapted to push the envelopes progressively against the wall 204.

The receiving unit 26 is preferably monitored by a convenient monitoring means to measure the volume of the envelopes stored therein and send a warning message of an exceed over the admissible volume of the envelopes to the controller unit.

The second chamber 202 is associated with the running belt system 88 of the conveyer unit 18 through a set of the feed rollers 212 for sending the enclosure to the conveyor unit 18 by the user's selection with program.

The receiver unit 26 may slidably be drawn out of the system casing to take the envelopes or the folded sheets out of the first chamber 200 or to fill the second chamber 202 with the enclosures and is provided with a sensor 214 for detecting when the receiver unit 26 is closed into the system casing.

The printing and post-processing system according to the invention may be used in three different modes such as a printing only, insertion only and combination of printing with insertion and the programs of operation modes with parameters are previously installed in the computer 10.

Figure 14:
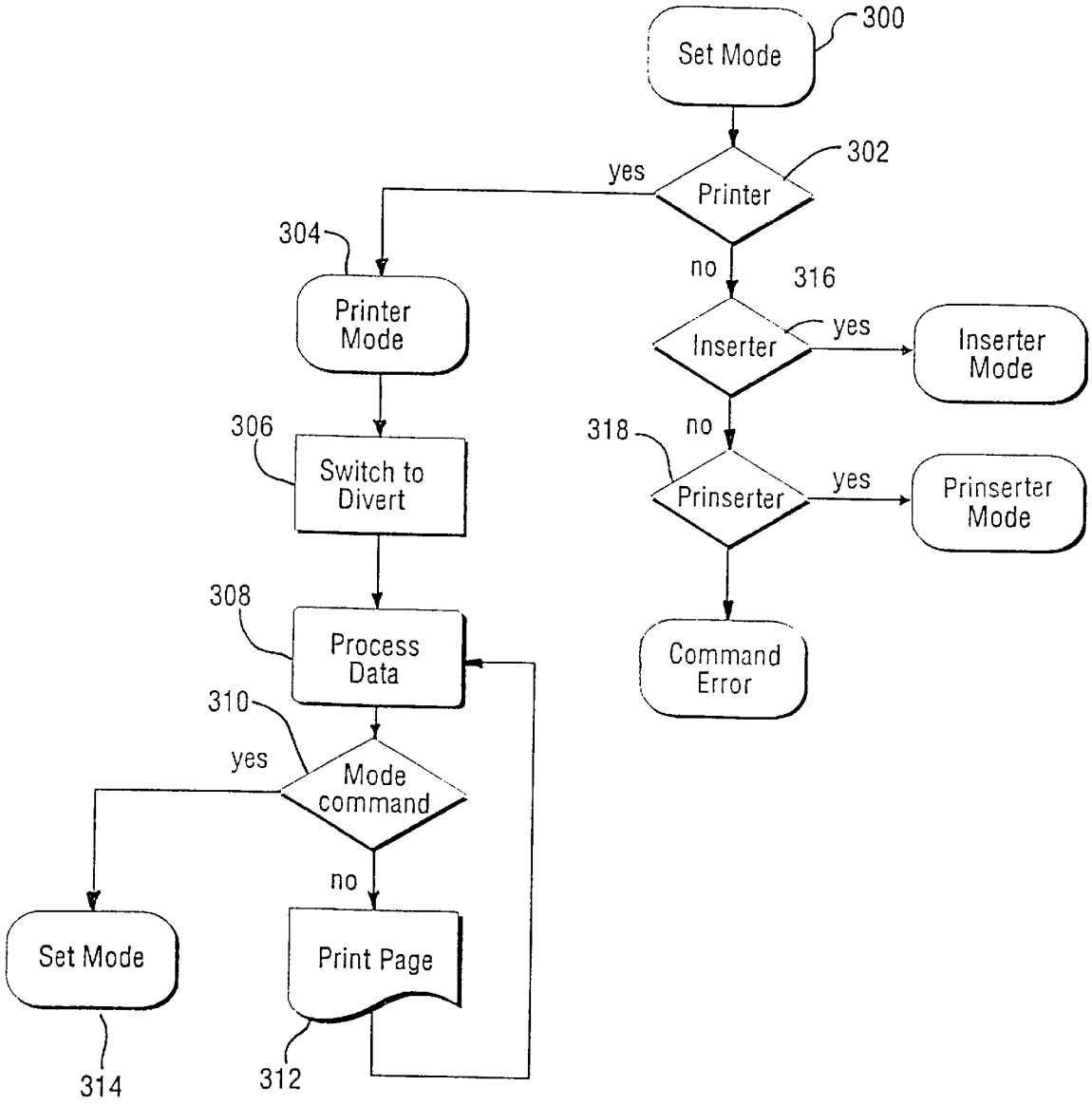
FIG. 14 is a flow chart of the printing only mode of the system according to the present invention.
Figure 15:
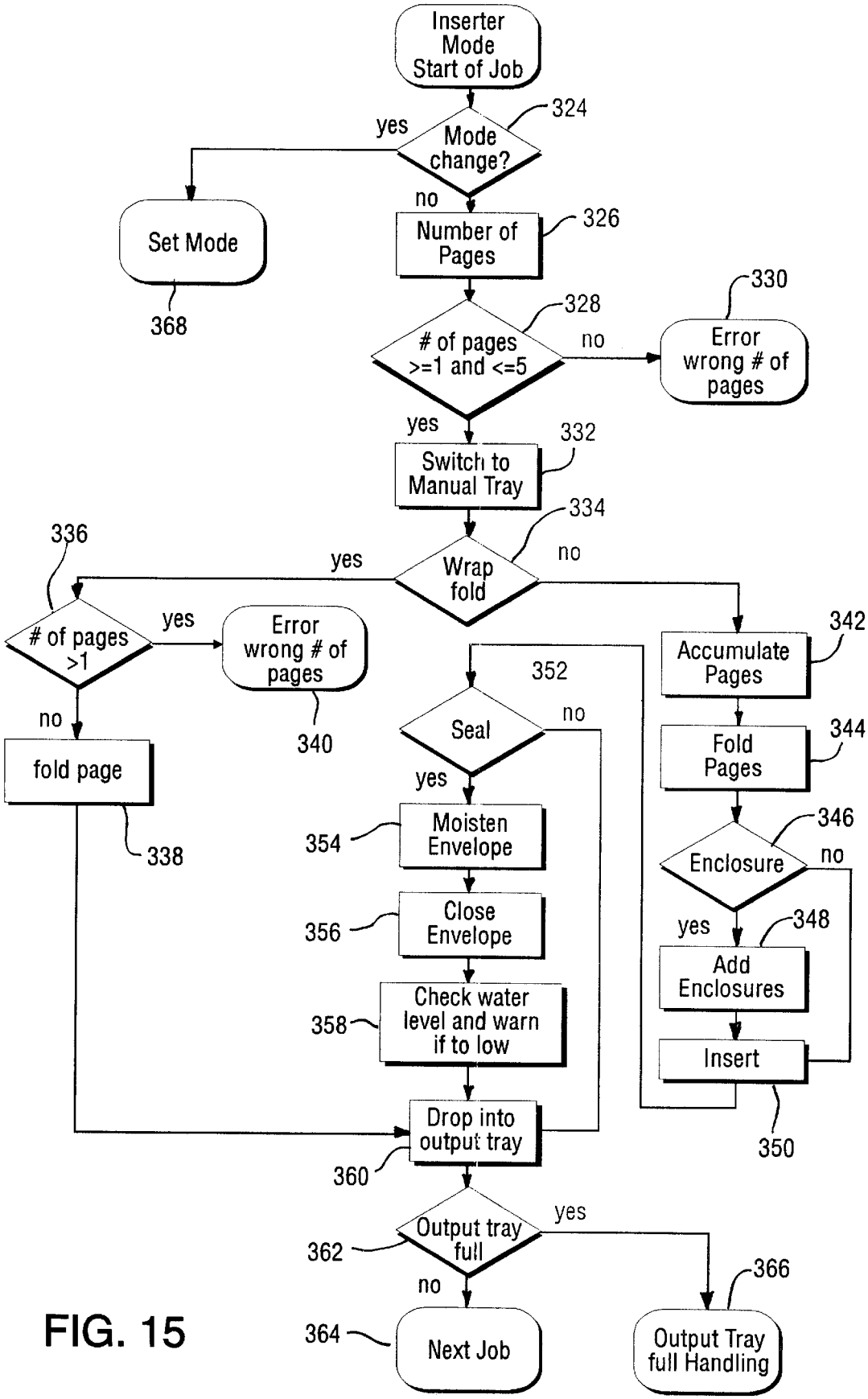
FIG. 15 is a flow chart of the insertion only mode of the system according to the present invention.

In FIGS. 14 to 16, when the start command is entered from the computer 10 into the printing and post-processing system, the system works automatically in order according to the selected mode. An operation of each units will be described in more detail with reference to the combination mode of printing with insertion.

Referring to FIG. 14, the operation mode is selected from three operation modes at the step 300 by means of the key board or the mouse of the computer 10.

When the printing mode is selected by the computer 10 at the step 302, a command of selection of the printing mode is at first sent from the computer 10 to the host controller 30 and then transmitted to the printer controller 32 and further fed back to the host controller 30 for final transmissions to the printer controller 32 and the inserter controller 34 respectively. The printing mode is thus installed in the system at the step 304.

In the printing mode, the printing and post-processing system according to the invention operates like a laser printer. An output operation of the printer 12 is set to a face down output by the printer controller 32 at the step 306 for biasing the sheet to the upper tray of the printer 12. Data to be printed on the sheet are sent from the computer 10 to the printer 12 for processing at the step 308 and subsequently printing at the step 312. When a mode selection command is detected by the printer controller 32 during the printing process at the step 310, the printing process is canceled for returning to the setting operation mode at the steps 314 and 300.

When the insertion mode is selected on the computer unit 10 at the step 316, a command of selection of the insertion mode is sent to the printer controller 32 and the inserter controller 34 through the host controller 30. The insertion mode is selected when the sheet after printed by the printer is introduced into the system according to the invention and the manual tray 68 is used free of printing process by the printer 12. The user may select several modes of operations on the computer 10, for example, inserting or not inserting the sheet into the envelope, closing or not closing the envelope and enclosing or not enclosing the enclosure in the envelope according to the need in business.

Referring to FIG. 15, when a command for changing an operation mode is not detected at the step 324 by the printer controller 32, the number of the sheets to be inserted into the envelope is determined by the user at the step 326. When the number of piece of the selected sheets is not less than one and not more than five at the step 328, an input of the sheet to the system is switched to the manual tray 68 from the output of the printer 12 by the printer controller 32 at the step 332. On the other hand, when the number of piece of the sheet is less than one or more than five at the step 328, a warning notice of error of the number of the sheets is issued for display on the computer monitor 36 at the step 330.

Further, when the manual tray is empty, the inserter controller 34 sends a warning notice of this for display on the computer monitor 36. The process is continued when the sheet is refilled and the command for continue is entered into the system from the computer unit 10.

For the folding operation, a mode of the folding of the wrap fold form or the Z-fold form is selected at the step 334. When the wrap fold is selected, the inserter controller 34 counts the number of piece of the sheets to be received by the accumulator 72 at the step 336. When the regular number is counted by the inserter controller 34, the sheet is folded for formation of the wrap fold and transferred to the receiver unit 26 for deposition at the steps 338 and 360.

While, when an irregular number is counted, then a warning notice of the irregular number is issued for display on the computer monitor 36 at the steps 336 and 340.

Returning again to the step 334, when the Z-fold is selected, the sheets of the predetermined number of pieces are accumulated in the accumulator 72 at the step 342. Subsequently, the sheets are folded and transferred to the insertion unit 22 at the step 344.

When an enclosing of the enclosure is commanded by the inserter controller 34 at the step 346, the enclosure feeding unit 28 activates to feed a piece of the enclosure to the insertion unit 22 through the conveyor unit 18 at the step 348 while the envelope is simultaneously fed to the insertion unit 22 by the envelope tray unit 20 for insertions of the sheet and the enclosure together into the envelope at the step 350.

The envelope with the sheet are normally fed to the sealing unit 24 for sealing purpose. The envelope when not desired to seal is however fed to the receiver unit 26 without exercising any sealing operation in the sealing unit 24 at the steps 352 and 360.

On the other hand, when the envelope is required to seal at the step 352, the gummed portion of the flap of the envelope is damped by the damping unit 176 at the step 354 for sealing by the sealing unit 24 at the step 356 and subsequently feeding to the receiver unit 28 at the step 360. When the level of the water for soaking the damping unit 176 is checked by the inserter controller 34 to find the water level less than the standard level, a warning notice of the lower water level is issued for display on the computer monitor 36 at the step 358.

The envelopes stored in the receiver unit 26 are monitored by the inserter controller 34. When the receiver unit 26 is full of the envelopes, a warning notice of the full state is issued by the inserter controller 34 for display on the computer monitor at the steps 362 and 366. This error may conveniently be overcome by manually taking the envelopes out of the receiver unit 26. The receiver unit 26 when not full of the envelope continues to receive the envelopes therein at the steps 362 and 364.

In FIG. 14, the operation of the combination of printing with insertion mode will be described with reference to the operations of the units of the system according to the invention.

The user may input a command for selection of the combination of printing with insertion mode at the step 318 by use of the keyboard 38 or the mouse 40 of the computer unit 10. The printing with insertion mode is selected when the sheet is desired to be printed by the printer 12 and the printed sheet is directly introduced into the system.

The command with the data to be printed on the sheet is sent from the computer unit 10 to the printer controller 32 through the host controller 30. The printer controller 32 receives the data to be printed only and resends the command to the host controller 30. The host controller 30 receives the command and identifies operation modes of the printer 12, the transfer unit 14, the folding unit 16, the conveyor unit 18, the envelope tray unit 20, the insertion unit 22, the sealing unit 24, the receiver unit 26 and the enclosure supplying unit 28 according to the software programs. The host controller 30 further sends the command to the printer controller 32 and the inserter controller 34 for instructing them to work on the combination of printing with insertion under the software programs.

Further, the user may select several modes of the operations on the computer 10, for example, the wrap fold or the Z-fold, inserting or not inserting the sheet into the envelope, sealing or not sealing the envelope and enclosing or not enclosing the enclosure into the envelope according to the need in business.

Figure 16A:
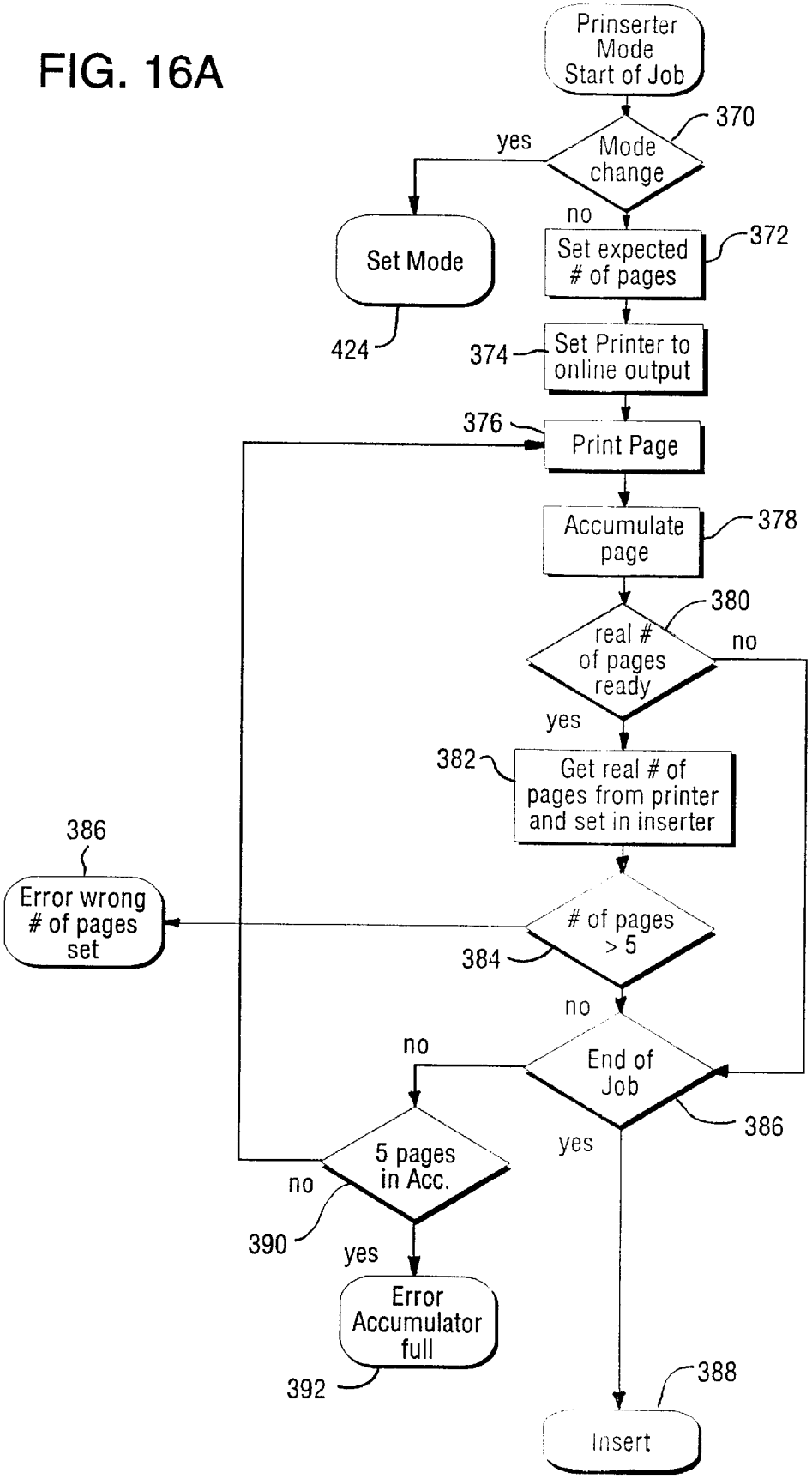
FIGS. 16A and 16B are flow charts of the combined printing with insertion mode of the system according to the present invention.
Figure 16B:
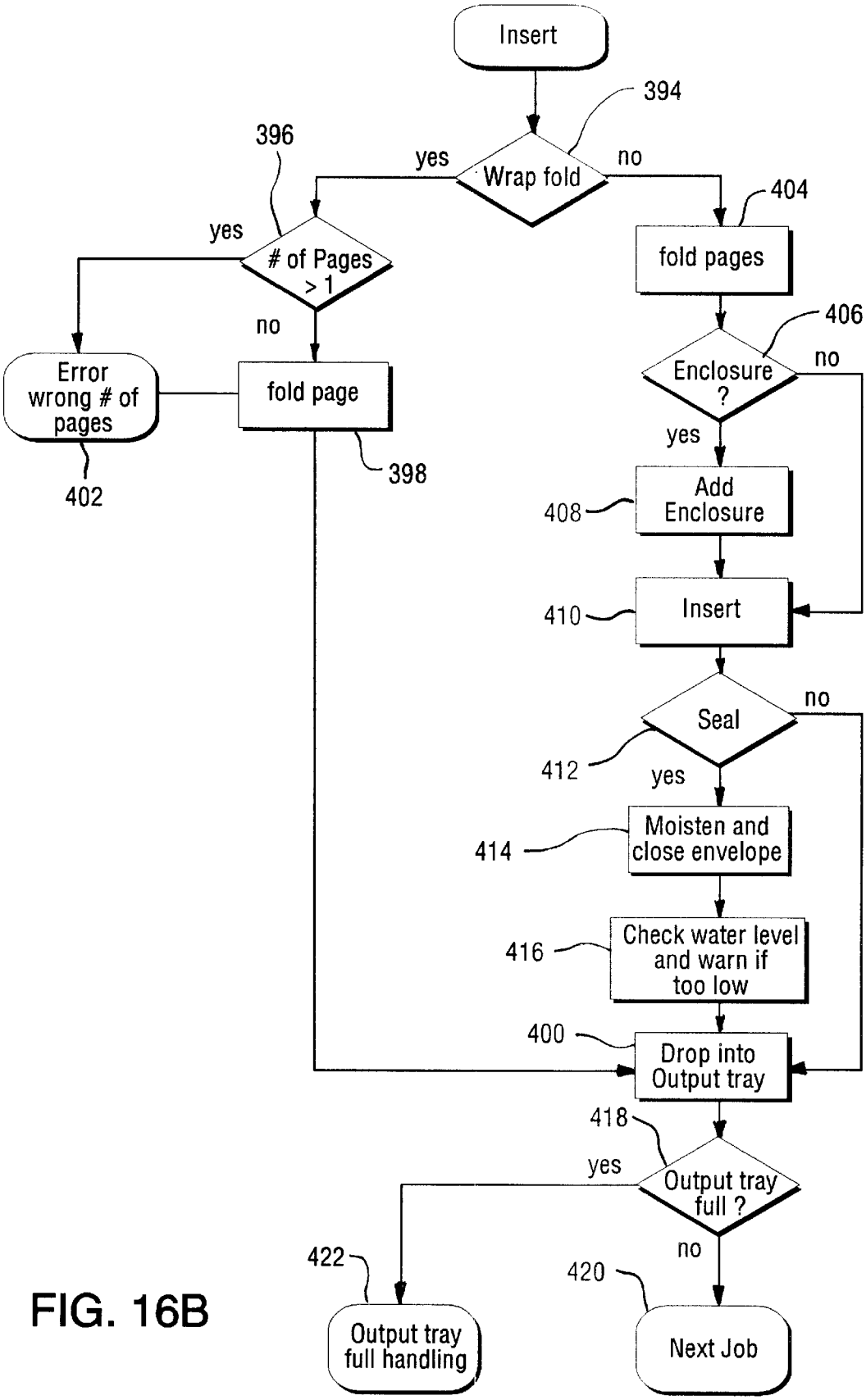
Figure 17:
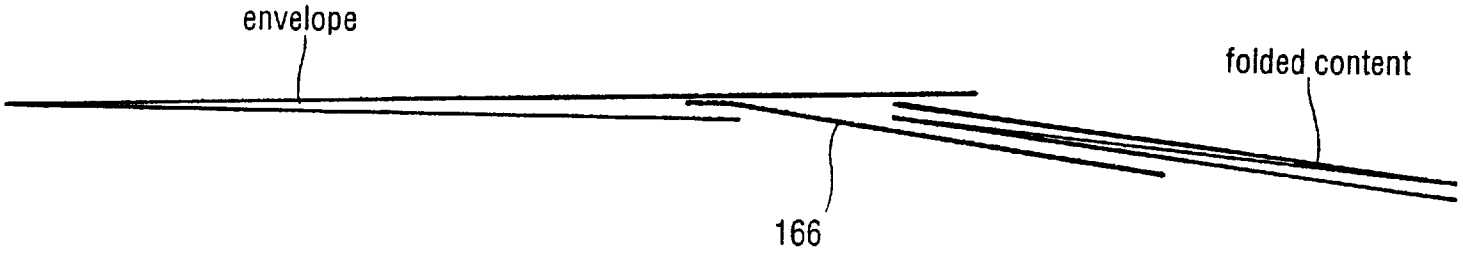
FIG. 17 is an enlarged schematic view showing the state of inserting the folded sheet into the envelope in the insertion unit of the system according to the invention.

Referring to FIGS. 16A and 16B, when a command for changing the operation mode is not detected at the step 370, an expected number of piece of the sheet to be inserted into the envelope is inputted to the printer controller 32 by means, for example, of a word processor and the like at the step 372.

An output of the printer 12 is set to the face up output by the switch member 52 under the instructions of the printer controller 32 for automatic transfer of the printed sheets to the transfer unit 14 at the step 374. Subsequently, the printer 12 prints the desired data on the sheet at the step 376 and then the printed sheets are introduced into the transfer unit 14 through the inlet 50 thereof for transfer of the sheets to the accumulator 72 passing through the feed path 54 at the step 378.

When the real number of piece of the sheet to be printed by the printer 12 is identified by the printer controller 32 during the printing process, the printer controller 32 notifies this to the inserter controller 34 at the steps 380 and 382.

When the real number of piece of the sheet is more than five, the inserter controller 34 sends a warning notice of error to the host controller 30 and then the host controller 30 transmits the warning message to the computer unit 10 for display on the computer monitor 36 at the steps 384 and 386. In this case, the switch member 52 is switched by the printer controller 32 to the face down output for diverting the printed sheets on the tray 46 after printing out of the five sheets.

In case the real number of piece of the sheets is not more than five, every steps are finished at the step 386 for continuation to the next steps at the step 388.

When the real number of piece of the sheet is zero, the printer controller 32 notifies this to the inserter controller 34 at the step 380 and then the operation of the inserter controller 34 is completed at the step 386. In case the real number of piece of the sheet is not notified by the printer controller 32 to the inserter controller 34, the operation by the inserter controller 34 is similarly finished at the step 386.

When more than five sheets are accumulated in the accumulator 72 at the step 390 even after the printer controller 32 notified the inserter controller 34 that the real number of piece of the sheet was not more than five at the step 382, the inserter controller 34 issues a warning message of error for display on the computer monitor 36 at the step 392. On the contrary, when the number of piece of the accumulated sheets are lacked as compared with the real number notified by the printer controller 32 at the step 390, the inserter controller 34 instructs the printer controller 32 to print the rest of the sheets at the step 376.

In operation of the system according to the invention, the user previously selects, when the combination of printing and insertion mode is used, the folding mode from the wrap fold or the Z-fold. The wrap fold is tolerated to add the enclosure but the Z-fold is suitable to deal with the letter only.

When the wrap fold is selected at the step 394, the inserter controller 34 counts the number of piece of the sheet in the accumulator 72 by means of the sensor 78 at the step 396. When the inserter controller 34 detects a single sheet to be accumulated in the accumulator 72, the sheet is folded for formation of the wrap fold at the step 398 as fully described with reference to FIGS. 5A and 5B.

Subsequently, the wrap-folded sheet is guided by the folding unit 16 between the belts 100 and 108 of the conveyor unit 18 for feed to the insertion unit 22.

When the wrap fold mode with an enclosure is selected, no envelope comes from the envelope tray unit 20 and the insertion unit 22 operates only for feeding the envelope to the sealing unit 24 under the control of the inserter controller 34 with software programs. The sheet is thus passed through the insertion unit 22 to the sealing unit 24 without receiving any operation by the insertion unit 22.

In the sealing unit 24, the sheet is introduced into the inclined path 174 of the first guide chute 172 and passed between the guide rollers 184 which lie in the biased position as shown in FIG. 11. By the instructions from the inserter controller 34 with software programs, the guide rollers 184 swing in a counterclockwise direction into the vertical position as shown in FIG. 12 under function by the cam piece 192 driven by the solenoid 194 so that the folded sheet is fed to the receiver unit 26 through the vertical path 198 at the step 400. The folded sheet when not to be inserted into the envelope receives no sealing operation but is directly fed to the receiver unit 26.

When the inserter controller 34 detects less than one sheet accumulated in the accumulator 72, a warning notice of error in the number of piece of the sheet is issued by the inserter controller 34 to the computer unit 10 for display on the computer monitor 36 at the steps 396 and 402.

Returning again to the step 394, when the Z-fold mode is selected by the user, the sheet is folded by the folding unit 16 for formation of the Z-folded sheet at the step 404 and then fed to the conveyor unit 18 as hereinbefore described with reference to FIGS. 6A and 6B.

When enclosing of the enclosure is commanded by the inserter controller 34 at the step 406, a piece of the enclosure is taken out of the enclosure supplying unit 28 by the feed rollers 212 for feed to the joining point 103 as shown in FIG. 7 through the running belt system 88 of the conveyor unit 18. The enclosure is temporarily caught by the hook member 91 before arriving to the joining point 103 for waiting an arrival of the folded sheet. When the folded sheet is made into contact with the sensor 99, the hook member 91 is retracted by the solenoid 97 under the instructions of the inserter controller 34 for feeding the enclosure to a meeting position 103. In the meeting position 103, the enclosure is added to the folded sheet and then they are introduced between the two belts 100, 108 of the conveyor unit 18 for transfer to the insertion unit 22 at the step 408.

The folded sheet and the added enclosure are caught by the hook member 150 and pushed by aligner 170 to the position just in alignment with the opening of the envelope waiting to receive them therein in the insertion unit 22.

On the other hand, a piece of the envelope superimposed in the tray body 110 of the enclosure tray unit 20 is picked up by the guide roller 116 for feed to the insertion unit 22 by the feed rollers 120, 122. The flap of the envelope is engaged with and turned over by the nail member 112 with simultaneous advancement of the envelope to the insertion unit 22. Further, when the tray body 100 of the enclosure tray unit 20 is empty, a warning notice of emptiness is issued by the inserter controller 34 for display on the computer monitor 36.

The envelope is supplied into the insertion unit 22 by the feed rollers 122 of the envelope tray unit 20 and fed by the feed rollers 140 and the insertion rollers 130 through the inclined path 138 and the guide channel 146 to the tilted path 160 where the folded sheet and the added enclosure are inserted into the envelope.

Once after the envelope is passed through the insertion rollers 130 and comes into contact with the sensor 164 in the tilted path 160, the envelope is returned by a short reverse rotation of the insertion rollers 130 for a predetermined distance to insert the tip end 168 of the claw arm member 166 into the opening of the envelope by the instructions of the inserter controller 34 with software programs.

Figure 18:
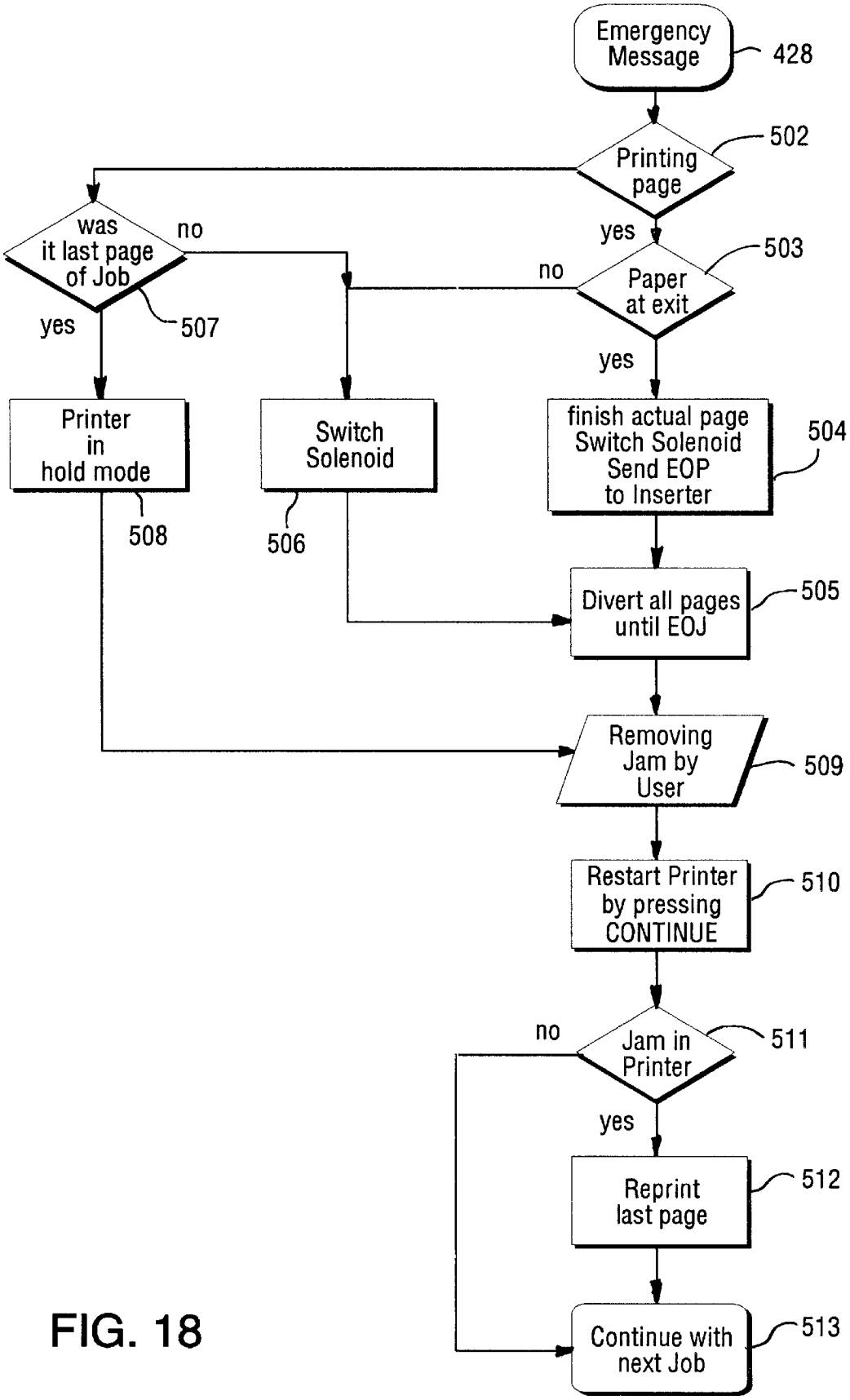
FIG. 18 is a flow chart of the paper jam recovering process of the system according to the present invention.

Subsequently, the hook member 150 is retracted by an actuation of the solenoid 156 upon receipt of the instruction from the inserter controller 34 with software programs and the folded sheet with the added enclosure are fed through the feed rollers 101 for insertion into the envelope via the claw arm member 166 at the step 410 as shown in FIG. 18.

The envelope with the folded sheet and the added enclosure are discharged against the sealing unit 24 through the second envelope discharge chute 158 at the step 412.

When the envelope is fed through the inclined path 174 of the sealing unit 24 and comes into contact with the sensor 182, the wet foam piece 180 supported by the support member 178 projects against the flap of the envelope for wetting the gummed portion of the flap upon receipt of the instructions from the inserter controller 34 with software programs at the step 414. Further, the inserter controller 34 receives a message of the water level of the water supplier (not shown) and when the water level comes lower than the allowed limit, then the inserter controller 34 issues a warning notice of the lower water level for display on the computer monitor 36 at the step 416.

As shown in FIG. 11, the guide rollers 184 catch the closed end of the envelope leaving the flap of the envelope in the inclined path 174 of the first chute 172. The guide rollers 184 swing by the cam piece 192 driven by the solenoid 194 in counterclockwise direction into the vertical position with folding simultaneously the flap of the envelope by the terminal edge of the first guide chute 172 and feed the envelope to the sealing rollers 189 for pressing the wet gummed flap to the envelope body for sealing as shown in FIG. 12. The sealed envelope is fed back by the reverse rotation of the guide rollers 184 and discharged through the vertical path 198 into the first chamber 200 of the receiver unit 26 for stacking.

When not enclosing of the enclosure is commanded by the inserter controller 34, the same operation as described hereinbefore is carried out for inserting the folded sheet only into the envelope through the conveyor unit 18 and the insertion unit 22 at the steps 406 and 410.

Further, when not sealing of the envelope is commanded by the inserter controller 34, the damping means 176 does not work but the envelope is still fed by the guide rollers 184 to the sealing rollers 189 with folding the flap of the envelope by means of the terminal edge of the first guide chute 172 at the steps 412 and 400.

In the receiver unit 26, the envelopes or the folded sheets are stored in the first chamber 200. When the envelope or the folded sheet is received from the sealing unit 24 into the first chamber 200 of the receiver unit 26, the two rotary discs 208 rotate to push the envelope or the folded sheet by means of the upstanding rods 210 provided thereon against the support wall 204 for supporting the envelopes or the folded sheets vertically in right order.

The first chamber is capable of storing up to two hundred fifty envelops or folded sheets. When the first chamber 200 becomes full of the envelopes or the folded sheets, a warning notice of this is issued by the inserter controller 34 for display on the computer monitor 36 at the steps 418 and 420. This error may conveniently be removed by taking the envelopes or the folded sheets out of the receiver unit 26.

The receiver unit 26 when not full of the envelope continues to receive the envelope or the folded sheet therein at the steps 418 and 420.

FIG. 18 shows a paper jam recovering process. When the paper jam occurs, the printer controller 32 and the inserter controller 34 are intercommunicated with each other through the host controller 30 for cooperatively recovering the paper jam. The host controller 30 sends a warning message of the paper jam for display on the computer monitor 36 upon receipt of a notice of the paper jam from the printer controller 32 and the inserter controller 34.

When the printer controller 32 receives a warning notice of the paper jam at the step 428, the printer controller 32 instructs the printer 12 to discontinue an actual printing process in case of presence of the sheet at the output of the printer 12 and switches the output of the printer 12 to the face down output for diverting the remaining printed sheets at the steps 502, 503, 504 and 505. Further, the printer controller 32 notifies a termination of the process to the inserter controller 34 at the step 504.

When no sheet remains in the output of the printer 12 at the step 503, the printer controller 32 switches the output of the printer 12 to the face down output for diverting the remaining printed sheets on the tray 46 at the steps 506 and 505.

On the other hand, when the last sheet remains for printing and the printer controller 32 receives the warning notice of the paper jam at the step 507, the printer controller 32 instructs the printer 12 to discontinue any further printing process until a next command is received at the step 508. The last sheet is printed out when a restart printing command is entered by the computer unit 10 at the step 512.

When remaining sheets to be printed by the printer 12 are more than one sheet at the step 507, the printer controller 32 switches the output of the printer 12 to the face down output for diverting the remaining sheets on the tray 46 until the end of the job command is received at the steps 506 ant 505.

The jammed sheets are removed from the printer 12, the transfer unit 14, the folding unit 16, the conveyor unit 18, the envelope tray unit 20, the insertion unit 22, the sealing unit 24, the receiver unit 26 or the enclosure supplying unit 28 before a restart printing command is entered by the computer unit 10 into the system at the steps 509 and 510.

Inserter mode, up to 250 pages are fed manually. With the computer, the operating mode and parameters are chosen and set. Then, the system will know how many pages have to be assembled per envelope, whether to add an enclosure and whether to seal the envelopes. The envelope format is automatically recognized. When the "Start" button is pressed, the system automatically proceeds with its work. If the manual feed tray is empty, the software will tell so on the screen. The job will be continued as soon as paper is refilled and the "continue" button is pressed.

Within the system, up to 5 pages are assembled before folding. The Z-folding ensures that the addresses are in the right position for the window envelopes. Envelope-sized enclosures are added after folding. If necessary, enclosures can be wrap-folded beforehand with Prinserter. Even this is interactively controlled with the computer. The enclosures are then manually put into the enclosure tray, which can hold up to 250 items.

In mode, all of these functions work together. The printer output is directly guided into the assembly module. The printer has two paper trays; so, the letter form can be fed from the upper tray and the further pages from the lower tray. Interactively controlled by the computer, the number of pages per envelope should be closed and whether an enclosure should be inserted. The pages are then assembled accordingly, folded, the enclosure added, the whole package inserted and the envelope closed. Up to 250 filled envelopes are output into the envelope tray unit. In case the job is changed, the parameter settings can be easily and comfortably changed and set right at the computer monitor. With a mouse-click, the system is ready for the next task.

If sheets need to be signed by hand, they are output in printer mode first, signed and then processed in inserter mode.

As described hereinbefore, according to the present invention, since all of the units of the printing and post-processing system is fully computerized under the control of the controllers with software programs, the user may conveniently apply the system for various modes of the operations such as the printing only mode, the insertion mode and the combination of the printing with insertion mode and the like by merely inputting some commands and parameters to the system. Even with the mode of enclosing the enclosure, the process speed does never go down since the sheets and the enclosure are simultaneously fed by the folding unit 16 and the conveyor unit 18 under control of the inserter controller 34 with software programs.

Further, the components of the system such as the printer, the folding unit, the insertion unit, the sealing unit and the receiving unit are physically integrated into a compact unit with remarkably reduced size.

Different functions that are logically connected and needed to a complete job, are integrated into one compact system. Operating and handling of the system are tailored to the needs of the users.

INDUSTRIAL APPLICABILITY

The printing press and post-processing system may conveniently be used by all who send confidential documents, serial letters, invitations, offers, invoices, daily mail, shipping documents such as adult education schools, advertising agencies, airlines, the army, authorities, bank outlets, brokers, building companies, car companies, chains of stores, chambers of handicrafts, churches, clubs communities, concert organizers, copy-shops, court offices, credit car companies, dancing schools, distributors, doctors, E-Post, employment offices, finance authorities, fitness club, golf clubs, hostels, inquiry offices, insurance agents, sales companies, schools, secretary offices, seminar organizers, sport clubs, suppliers, tax advisers, tennis schools, trade show organizers, tennis schools, trade show organizers, training centers, travel agencies—but to name a few.

Whereas modifications of the present invention will no doubt be apparent to a person of ordinary skilled in the art to which the invention pertains, it is to be understood that the embodiments shown and described by way of illustration are by no means intended to be considered in a limiting sense. Accordingly, it is intended that the claims to cover all modifications of the invention which fall within the spirit and scope of the invention.

We claim:

1. A mailing system which performs selectively several operations under the control of a computer with software programs by previously inputting commands and parameters to the system, which comprises:

a computer unit for instructing and controlling the system as a whole;

a printer associated through a controller unit with the computer unit for selectively printing a sheet to be mailed;

a transfer unit connected to the printer and a manual tray for transferring the sheet to a folding station by the software instructions and under actuation with a first sensing means;

a folding unit connected in series to the transfer unit for accumulating, folding and feeding the sheet by the programmed instructions and under actuation with a second sensing means;

a conveyor unit arranged in association with the folding unit for conveying the folded sheet with a selectively added enclosure to an insertion station;

an enclosure supplying unit associated with the conveyor unit for selectively supplying an enclosure to the conveyor unit for addition to the sheet by the programmed instructions and under actuation with a third sensing means;

an envelope tray means associated with the conveyor unit for stacking a plurality of empty envelopes and feeding the same by piece with means for engaging with and turning over a flap of the envelope while leaving the tray;

an insertion unit arranged between the conveyer unit and the envelope tray means for inserting the sheet into the envelope and subsequently transferring the enclosed envelope to a sealing station;

a sealing unit associated with the insertion unit for closing and sealing the flap; and a receiver unit disposed in abutment with the sealing unit and in association with the enclosure feeding unit for receiving and storing the sealed envelopes.

2. A mailing system according to claim 1, wherein the controller unit comprises a printer controller for controlling the printing operation of the printer, an inserter controller for controlling the sheet folding, the sheet transfer, the sheet insertion into the envelope, the envelope sealing as well as the finished envelope deposit in the receiver unit and a host controller connected to the computer unit, and the printer controller and the inserter controller are interactively communicated with each other for whole control of the system.

3. A mailing system according to claim 1, wherein the transferring unit includes a mechanism for selectively transferring the sheet to the folding unit.

4. A mailing system according to claim 3, wherein the mechanism for selectively transferring the sheet to the folding unit comprises a manual tray for manually stacking and automatically transferring the sheet to the folding unit, a coupling means connected to an output of the printer for automatically transferring the printed sheet to the folding unit, and a path means with feed rollers for feeding the sheet to the folding unit, one terminal of which is branched into two ways with feed rollers for connecting to the manual tray and the coupling means respectively whereas the opposite terminal thereof is connected to a first stopper means of the folding unit for determining a folding position of the sheet.

5. A mailing system according to claim 1, wherein the folding unit includes:

an accumulating means associated with the path means of the transfer unit for accumulating one or more sheet for folding;

a first automatic and programmable adjusting means movably connected to the accumulating means; and a guide roller means operatively associated with the accumulating means for guiding and folding the sheet in cooperation with a second automatic and programmable adjusting means movably connected to the guide means.

6. A mailing system according to claim 5, wherein the folding unit operates in selection two fold modes of a wrap fold and a Z-fold of the sheet by varying positions of the first and second adjusting means, and parameters as such the type of folding including the wrap fold and the Z-fold and a sheet size adjustment are controlled by the inserter controller with software programs.

7. A mailing system according to claim 1, wherein the conveyor unit provides:

a first running belt system with a main driving roller, guide rollers and a belt suspended therearound and connected to the enclosure supplying unit for conveying the enclosure; and a second running belt system having a driving roller and driven guide rollers and a belt suspended therearound and partially made into contact with the belt of the first running belt system for passing therethrough the folded sheet and the enclosure selectively added.

8. A mailing system according to claim 7, wherein the second running belt system is provided with a hook means for temporarily catching the enclosure for synchronizing the feeding of the folded sheet and a sensor for detecting arrival of the folded sheet to activate the hook member for retraction.

9. A mailing system according to claim 1, wherein the envelope tray unit includes:

a tray body automatically to be elevated by an elevator means for superimposing therein a plurality of envelopes;

a nail member resiliently supported by a crank arm for engaging with and turning over the flap of the envelope; and a set of feed rollers for feeding the envelope by piece to the insertion unit including a guide roller which is resiliently in touch with the top envelope superimposed.

10. A mailing system according to claim 9, wherein the envelop tray unit includes means for detecting the sizes of the envelope and the flap thereof superimposed on the tray body.

11. A mailing system according to claim 1, wherein the insertion unit includes:

two feed rollers disposed symmetrically for feeding and subsequently somewhat moving back an empty envelope to a joining position with the folded sheet to be inserted therein;

a claw means operable to be inserted into an opening of the envelope for guiding the folded sheet and the additional enclosure into the envelope; and a positioning means for placing the folded sheet in alignment with the envelope for smooth insertion of the sheet thereinto.

12. A mailing system according to claim 1, wherein the insertion unit includes:

insertion rollers including a driving roller and a guide roller where the folded sheet is inserted into the envelope;

a first envelope discharge chute communicated at its one end with the envelope tray unit and having therein an inclined path with a set of feed rollers for feeding the envelope against the insertion rollers;

a guide segment disposed in abutment with an open end of the first envelope discharge chute and in confronting relation with the driving roller and having a guide surface curved along a partial circle of the driving roller with a specified clearance to provide a guide channel between the driving roller and the guide segment;

a sheet holder disposed in the conveyor unit for suspending further passing of the folded sheet and holding the same in stand by before approaching to the insertion rollers and comprised of a hook member connected at its one end to a crank arm connected in turn to a plunger driven by a solenoid by instructions from the inserter controller;

a second envelope discharge chute disposed in the down stream against the insertion rollers for once receiving the empty envelope passed through the insertion rollers, returning the same envelope against the insertion rollers for a predetermined distance to receive therein the folded sheet guided by the guide rollers and then discharging the envelope inserted with the folded sheet against the sealing unit and providing a tilted path with confronting feed rollers, a sensor for detecting arrival of the empty envelope in the second envelope discharge chute and sending a message of arrival to the inserter controller for instructing the insertion rollers to effect a short reverse rotation by which the envelope once received in the second envelope discharge chute is somewhat returned against the insertion rollers for the predetermined distance to receive therein the folded sheet and a claw arm member provided in an entrance of the second envelope discharge chute and having a tip end adapted to be inserted into an opening of the envelope just when returned for facilitating a smooth insertion of the folded sheet into the envelope; and an aligner provided in the vicinity of the holder for pushing the folded sheet to the position just in alignment with the opening of the envelope waiting to receive the folded sheet therein.

13. A mailing system according to claim 1, wherein the sealing unit comprises;

a first chute connected to an outlet of the insertion unit for guiding an impregnated envelope therein and provided at its delivery a flap bending member to turn over the flap of the envelope;

a damping means provided at the entrance of the first chute for wetting the gummed portion of the envelope and including a water tank, a water impregnating segment and a water supply means disposed between the water tank and the water impregnating segment;

swingable rollers arranged in a swingable crank confronted with the flap bending member for receiving a closed end of the envelope and then moving the envelope somewhat outwardly;

sealing rollers disposed in the vicinity of the swingable rollers for pressing and sealing the bent flap of the envelope;

a turnable cam means arranged in contact with the swingable crank for swinging the swingable roller under the function of a spring means; and a second chute to be formed with an elongated arm member of the swingable crank for feeding the sealed envelope into the receiver unit.

14. A mailing system according to claim 13, wherein the sealing unit provides a detection means for detection of arrival of the envelope, a damping means for applying a water to a gummed portion of the flap of the envelope in response to the detection of arrival of the envelope, and a water level measurement means for measuring a water level in a water tank and issuing a warning of exceed over an admissible low level.

15. A mailing system according to claim 1, wherein the sealing unit is composed of:

a first guide chute having therein an inclined path and provided at its inlet portion with a movable damping means including a support member for bearing a wet foam piece connected to a water supplier and its outlet portion with a sensor sensible to receipt of the envelope in the inclined path for sending a message to the inserter controller to instruct the damping means a projection of the wet foam piece against the flap of the envelope for wetting;

a set of the guide rollers swingably arranged with a swing crank member having a crank arm for once receiving in the biased position the envelope sent through the path of the first guide chute and then feeding in the vertical position the envelope against the sealing position, sealing rollers for receiving with press the envelope and sealing the wet gummed flap to the envelope body; and a cam mechanism disposed in engagement with the swing crank member to provide a swing motion thereof and including a cam piece and a solenoid connected thereto and a second guide chute which is formed when the crank arm of the swing crank member is turned to the vertical position to provide a vertical path and provided with a sensor for detecting a passing of the sealed envelope through the vertical path to activate the receiving unit.

16. A mailing system according to claim 1, wherein the receiver unit includes:

a chamber for receiving the sealed or unsealed envelope fed from the sealing unit;

an upstanding support wall movably arranged in the chamber for supporting the envelope vertically in right order; and pushing means disposed in juxtaposition to the support wall for pressing the envelopes thereagainst.

17. A mailing system according to claim 16, wherein the rotary pushing means comprises two rotary discs arranged in the confronting relation, each disc providing with spaces four upstanding rod members for progressively pressing the envelope upon rotations of the discs.

18. A mailing system according to claim 16, wherein the receiver unit is provided with an envelope monitor means for monitoring the volume of the envelopes stored therein, and commanding to display an exceed over an admissible volume of the envelopes to be stacked in the receiving unit.

19. A mailing system according to claim 1, wherein the receiver unit and the enclosure supplying unit are slidably accommodated in a common casing for open and close to take the envelopes and/or the folded sheets out of the receiver unit and to fill the enclosure supplying unit with the enclosures to be inserted into the envelope.

20. A mailing system comprising:

a first means for inputting data and commands necessary to control and operate the system;

a second means for receiving the data from the first means for identification and sending the commands to the system for control;

a third means for receiving the data from the second means to control a printing operation of the printer and to output an information including an operation state of the printer;

a fourth means for receiving the data from the second means to control the folding, transferring and inserting operations of the sheet and also the sealing and depositing operations of the envelope and then output an information including operational states in respective steps;

a fifth means contained in the first means for receiving the data from the third and fourth means to monitor the printing operation and output an information including an operational status of the system;

a sixth means contained in the first means for receiving the data from the fifth means to display; and a seventh means contained in the first means for receiving the data from the sixth means to select an operation mode of the system for a printing mode, an inserting mode or a printing and inserting mode and to send a selection signal to the second means.

21. A mailing system according to claim 20, further comprising means associated with the third means for switching an output of the printer from a face up output to a face down output used for only printing or diverting the sheet and vice versa.

22. A mailing system according to claim 20, further comprising means associated with the fourth means for controlling operations to print or not print the sheet, to insert or not insert the sheet into the envelope, to enclose or not enclose the enclosure and to seal and not seal the flap of the envelope.

23. A mailing system according to claim 20, further comprising means associated with the fourth means for detecting an emptiness of the envelope in the envelope tray unit.

24. A mailing system according to claim 20, further comprising:

means associated with the second means to select a manual supply of the sheet to be mailed;

means associated with the first means for commanding through the sixth means to select the folding modes for a wrap fold mode or a Z-fold mode and to send a selection signal to the second means;

means associated with the fourth means for commanding an accumulation of the sheet fed from the manual sheet supply means by counting the number of pieces accumulated therein and detecting an exceed over permissible number of accumulation for warning;

means associated with the fourth means for commanding the folding means to perform selectively the wrap fold mode or the Z-fold mode;

means associated with the fourth means for commanding feed of the sheet to the receiver unit free of enclosure when the wrap fold mode is selected;

means associated with the fourth means for detection of the presence of enclosures deposited in a box;

means associated with forth means for commanding a conveyance of the enclosure to the insertion means for introduction into the envelope together with the sheet; and means associated with the fourth means for sealing and transferring the envelope to the receiver unit.

25. A mailing system according to claim 20, further comprising:

means associated with the third means for commanding the printer control means to input a desired number of the sheet to be printed;

means associated with the third means for commanding connection of the face up output of the printer to the folding means;

means associated with the first means for commanding through the sixth means to select the folding modes for a wrap fold mode or a Z-fold mode and to send a selection signal to the second means;

means associated with the fourth means for commanding an accumulation of the sheet fed from the printer by counting the number of pieces accumulated therein and detecting an exceed over permissible number of accumulation for warning;

means associated with the fourth means for commanding the folding means to perform selectively the wrap fold mode or the Z-fold mode;

means associated with the fourth means for commanding feed of the sheet to the receiver unit free of enclosure when the wrap fold mode is selected;

means associated with the fourth means for detection of the presence of enclosures deposited in a box;

means associated with forth means for commanding conveyance of the enclosure to the insertion means for introduction into the envelope together with the sheet; and means associated with the fourth means for sealing and transferring the envelope to the receiver unit.

26. A mailing system according to claim 20, further comprising;

means associated with the third and forth means for commanding detection of the sheet jam and an output of the warning notice for computer display;

means associated with the third means for commanding discontinue of the printing operation and switching the operation into the face down output operation upon detection of the warning notice with subsequent of the sheet to the face down tray; and means associated with the first means for commanding restart of the printer after removal of the sheet jam.

27. A method of controlling a mailing system comprising the steps of:

selecting one of three operation modes of printing, inserting and printing with inserting, processing in case the printing mode is selected the data in the printer for printing on the sheet with selection to continue or discontinue or divert the printing operations;

manually inserting in case the inserting mode is selected by software the sheet into a manual tray for preparation of transferring the sheet to the folding unit, predetermining a desired number of sheet to be enclosed in an envelope, displaying a warning notice when an admissible volume of the sheet to be enclosed in the envelope is exceeded;

selecting a mode of the folding into a wrap fold mode when an enclosure is desired to be enclosed with the sheet, verifying one piece of the sheet to be folded in the wrap mode, sending a warning notice when more than one piece of the sheet entails and folding the sheet and feeding the same with the enclosure into the receiver unit;

selecting a Z-fold mode by software when an insertion of the sheet into the envelope is desired, transferring the sheet to an accumulation means, taking the sheet out of the accumulation means, folding with rollers and subsequently transferring the folded sheet to the insertion means, inserting the sheet into the envelope, feeding the inserted envelope to the sealing means by wetting a gummed flap of the envelope, closing and sealing the flap of the envelope, and feeding the sealed envelope to the receiver unit;

setting in case the printing with inserting mode is selected a desired number of sheet to be printed and inserted into the envelope, setting the printer to transfer the printed sheet to the accumulator, accumulating the sheets to be folded, folding the sheet with rolls and transferring the folded sheets to the insertion means;

selecting a wrap fold mode when an enclosure is desired to be inserted, verifying presence of a piece of the sheet to be folded in the wrap mode, sending a warning notice to the computer when the sheet in the wrap mode exceeds over one limited piece and folding the sheet and feeding the same with the enclosure to the receiving unit;

selecting a Z-fold mode when an insertion into an envelope is not desired, accumulating the sheet in the accumulator, taking the sheet out of the accumulating means, folding the sheet with rolls, conveying the folded sheet to the insertion means, inserting the sheet into the envelope, feeding the enclosed envelope to the sealing means by wetting a gummed flap of the envelope, closing and sealing the flap of the envelope and feeding the sealed envelope to the receiving unit.

28. A method of controlling a mailing system according to claim 27, wherein the insertion mode further includes a step of detecting the presence of an enclosure in the box and feeding the enclosure to the folded sheet.

29. A method of controlling a mailing system according to claim 27, wherein the inserting mode further includes a step of detecting a volume of the envelopes stored in the receiving unlit to issue a warning notice by displaying on the computer monitor when the envelopes exceed an admissible volume.

30. A method of controlling a mailing system according to claim 27, wherein the printing and inserting mode includes the steps of detecting a volume of the sheet accumulated in the accumulating means, issuing a warning notice when the sheets exceed an admissible volume, instructing the printer to discontinue or divert printing of the sheet remained therein and also the transferring unit to further discontinue feed of the sheet to the accumulating unit.

31. A method of controlling a mailing system according to claim 27, further comprising the steps of:

checking an operational state of the printing means when the sheet jam occurs;

switching an activation of the printer to a face down output to print the remaining data in the sheet after the printing operation is discontinued and when the printing process is not completed;

holding discontinuing state of the printing operation before receiving the next data for operation when a last piece of the sheet is still remained in the printer for printing; and instructing the printer to restart after a sheet jam is removed.

* * * * *